US007793438B1

(12) United States Patent
Busse et al.

(10) Patent No.: US 7,793,438 B1
(45) Date of Patent: Sep. 14, 2010

(54) REAR ENTRY FOOTWEAR

(75) Inventors: Mark Busse, Providence, RI (US); William Marvin, Brighton, MA (US)

(73) Assignee: Reebok International Ltd., Canton, MA (US)

( * ) Notice: Subject to any disclaimer, the term of this patent is extended or adjusted under 35 U.S.C. 154(b) by 877 days.

(21) Appl. No.: 11/627,917

(22) Filed: Jan. 26, 2007

(51) Int. Cl.
*A43B 11/00* (2006.01)

(52) U.S. Cl. ..... 36/105; 36/69; 36/138

(58) Field of Classification Search ..... 36/105, 36/69, 58.5, 58.6, 138, 99
See application file for complete search history.

(56) References Cited

U.S. PATENT DOCUMENTS

| | | | | |
|---|---|---|---|---|
| 474,574 | A | | 5/1892 | Bruzon |
| 955,337 | A | | 4/1910 | Lawlor |
| 2,452,502 | A | * | 10/1948 | Tarbox ..... 36/87 |
| 2,736,110 | A | * | 2/1956 | Hardimon ..... 36/58.5 |
| 3,014,288 | A | * | 12/1961 | Evans et al. ..... 36/1 |
| 3,097,438 | A | * | 7/1963 | Evans ..... 36/1 |
| 3,261,114 | A | * | 7/1966 | Saunders ..... 36/138 |
| 3,681,860 | A | * | 8/1972 | Bidegain ..... 36/112 |
| 3,798,802 | A | * | 3/1974 | Saunders ..... 36/138 |
| 4,551,933 | A | | 11/1985 | Morell et al. |
| 4,587,747 | A | | 5/1986 | Courvoisier et al. |
| 4,813,668 | A | | 3/1989 | Solloway |
| 4,823,484 | A | | 4/1989 | Couty |
| 4,905,384 | A | | 3/1990 | DeMarchi et al. |
| 4,944,099 | A | | 7/1990 | Davis |
| 4,959,914 | A | | 10/1990 | Hilgarth |
| 4,972,613 | A | | 11/1990 | Loveder |
| 5,152,084 | A | | 10/1992 | Bonnaventure |
| 5,184,410 | A | | 2/1993 | Hamilton |
| 5,222,313 | A | | 6/1993 | Dowdy et al. |
| 5,282,327 | A | | 2/1994 | Ogle |
| D347,314 | S | | 5/1994 | Uda |
| 5,329,707 | A | | 7/1994 | Chaigne et al. |
| 5,481,814 | A | | 1/1996 | Spencer |
| 5,557,866 | A | | 9/1996 | Prengler |
| 5,813,144 | A | | 9/1998 | Prengler |
| 6,189,239 | B1 | | 2/2001 | Gasparovic et al. |
| 6,298,582 | B1 | | 10/2001 | Friton et al. |
| 6,539,647 | B2 | | 4/2003 | Diaz |
| 6,594,921 | B2 | | 7/2003 | Laio et al. |

(Continued)

FOREIGN PATENT DOCUMENTS

| | | |
|---|---|---|
| DE | 1931800 | 3/1970 |

(Continued)

*Primary Examiner*—Marie Patterson
(74) *Attorney, Agent, or Firm*—Sterne, Kessler, Goldstein & Fox P.L.L.C.

(57) ABSTRACT

An article of footwear includes a sole having a shank area located between a forefoot portion and a rear foot portion of the sole, an upper including an inner counter and an outer counter, and a pivot mechanism attaching the outer counter to the sole so as to permit the outer counter to pivot relative to the inner counter at a pivot point located at the shank area of the sole. The outer counter pivots between an open position away from the inner counter and a closed position in supporting engagement with the inner counter. The pivot mechanism may be a mechanical, composite, or living hinge. The article of footwear may further include a locking mechanism for selectively securing the outer counter in the closed position in supporting engagement with the inner counter.

19 Claims, 25 Drawing Sheets

U.S. PATENT DOCUMENTS

| | | | | |
|---|---|---|---|---|
| 6,684,533 | B1 | 2/2004 | Su | |
| 7,168,188 | B2 * | 1/2007 | Auger et al. | 36/69 |
| 7,607,242 | B2 * | 10/2009 | Karandonis et al. | 36/105 |
| 2005/0039348 | A1 | 2/2005 | Raluy et al. | |
| 2007/0011917 | A1 * | 1/2007 | Hayes | 36/105 |
| 2008/0168683 | A1 * | 7/2008 | Keating | 36/102 |

FOREIGN PATENT DOCUMENTS

| | | |
|---|---|---|
| DE | 3629292 | 3/1988 |
| WO | WO 92/03943 | 3/1992 |
| WO | WO 97/37556 | 10/1997 |
| WO | WO 03/039283 | 5/2003 |

* cited by examiner

REAR ENTRY FOOTWEAR

BACKGROUND OF THE INVENTION

1. Field of the Invention

The present invention relates to footwear generally, and in particular, relates to footwear having an articulated heel portion that selectively engages the heel of the user to allow easy donning and doffing by entry and exit of a user's foot at the rear of the footwear.

2. Background Art

A variety of different types of footwear have been designed to suit the different lifestyles and activities of people. Such footwear include flip-flops, sandals, mules, slides, clogs, athletic shoes, boots, and even specialty shoes like soccer shoes, bicycling shoes, and dance shoes. Footwear that may be slipped on and off with ease such as clogs, mules and flip-flops have been particularly popular because they permit entry into the shoe, without the need to widen a foot opening at the top of the shoe. Such a foot opening is typically present in footwear for active use, such as basketball, tennis, and running activities. Footwear for active use generally includes secure closure mechanisms along the top and the heel of the foot to ensure that the footwear does not slip off the foot during the chosen activity. Laces or straps extend across the foot opening and are tightened to secure the foot within the shoe. Slip-on footwear is generally not suitable for active use because such closure mechanisms are absent.

While donning and doffing footwear is typically second nature to many people, it may still present a difficulty for small children, elderly, and people with limited leg mobility, especially when the footwear includes closure mechanisms. These people may need assistance putting on such footwear.

Accordingly, what is needed is footwear, particularly footwear for active use, which may be securely fastened and unfastened from the foot of the user with minimum hassle, and further addresses both the problems of ease of use, fit, and performance, as well as effectiveness in construction.

BRIEF SUMMARY OF THE INVENTION

An article of footwear includes a sole having a shank area located between a forefoot portion and a rear foot portion of the sole, an upper including an inner counter and an outer counter, and a pivot mechanism attaching the outer counter to the sole. The pivot mechanism permits the outer counter to pivot relative to the inner counter at a pivot point located at the shank area of the sole, the outer counter pivoting between an open position away from the inner counter and a closed position in supporting engagement with the inner counter. In one embodiment, the pivot mechanism is a mechanical hinge. In another embodiment, the pivot mechanism is a composite hinge. The article of footwear may further include a locking mechanism for selectively securing the outer counter in the closed position in supporting engagement with the inner counter.

In one embodiment, the inner counter includes a vertically extending rear heel portion, lateral and medial side members and a shank member. The lateral and medial side members extend longitudinally from the first rear heel portion to the shank area of the sole along lateral and medial sides of the footwear, and the shank member extends laterally between the lateral and medial side members at the shank area of the sole. In another embodiment, the outer counter also includes a vertically extending rear heel portion, lateral and medial side members and a second shank member. The second lateral and medial side members extend longitudinally from the second rear heel portion to the shank area of the sole along lateral and medial sides of the footwear. The second shank member extends laterally between the second lateral and medial side members at the shank area of the sole, and the shank member of the inner counter and second shank member of the outer counter are pivotally attached together by the pivot mechanism.

In another embodiment, the sole includes a full foot midsole and a rear foot midsole, and the rear heel portion, lateral and medial side members and the shank member of the inner counter define an opening. A rear portion of the full foot midsole covers the opening so as to form a heel bed, and the rear heel portion of the inner counter vertically extends from a periphery of the heel bed. The outer counter forms an outer heel cup having a bottom member extending between the second rear heel portion, second lateral and medial side members and the second shank member, and the rear foot midsole is attached to a bottom surface of the bottom member. A top surface of the bottom member abuts a bottom surface of the rear portion of the full foot midsole when the outer counter is in the closed position.

In another embodiment, the pivot mechanism is a living hinge, which allows the outer counter to pivot between the open and closed positions. In this embodiment, a bottom anchor portion adheres the outer counter to a bottom side of a full foot midsole forward of the shank area of the sole. The living hinge joins the bottom anchor portion to a bottom member of the outer counter. The living hinge, the bottom anchor portion, and the bottom member of the outer counter may be integrally formed as a one-piece structure.

BRIEF DESCRIPTION OF THE DRAWINGS/FIGURES

The foregoing and other features and advantages of the present invention will be apparent from the following, more particular description of a preferred embodiment of the invention, as illustrated in the accompanying drawings, in which like reference numerals are generally used to indicate identical or functionally similar elements. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in other applications.

Figure 30A:
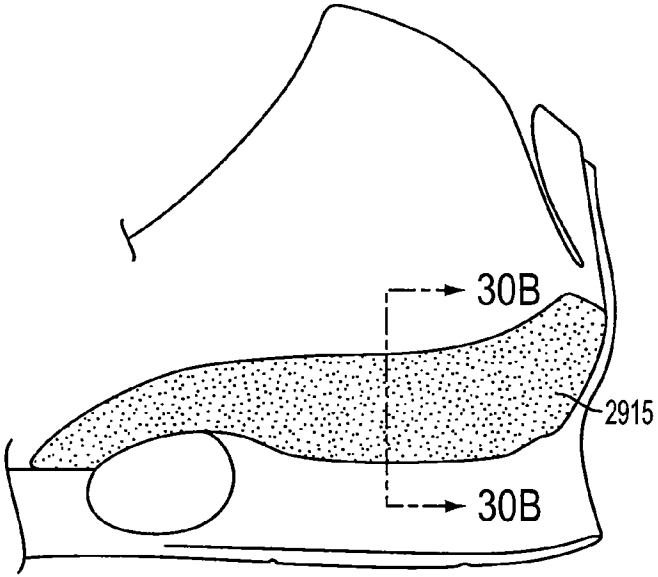
FIG. 30A is a side view of the inner counter of FIG. 29.
Figure 30B:
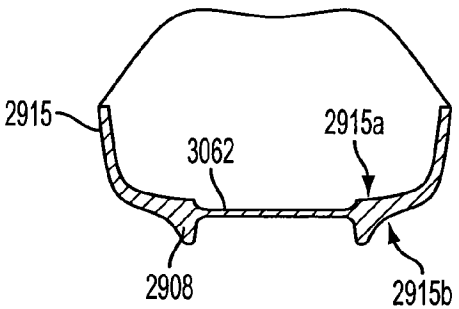

FIG. 30B cross-sectional view taken along line 30B-30B of FIG. 30A.

Figure 31A:
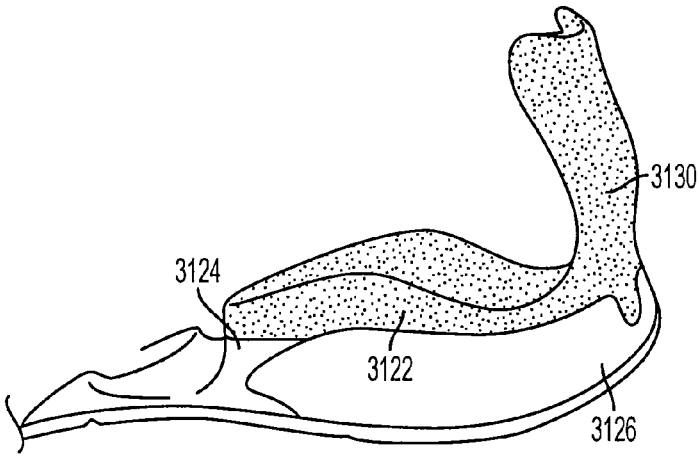

FIG. 31A is a perspective view of an articulated heel portion of a shoe according to an embodiment of the present invention.

Figure 31B:
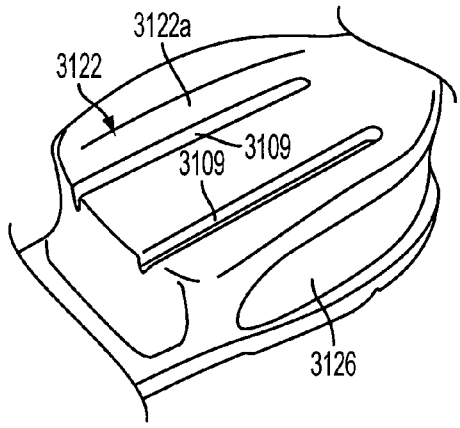

FIG. 31B is a perspective view of an over-mold component on a rear foot midsole of the articulated heel portion of FIG. 31A.

Figure 31C:
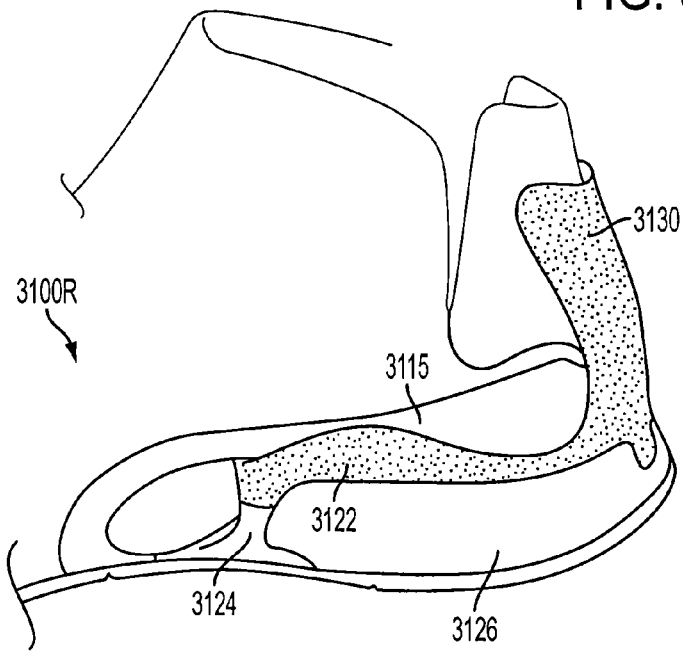

FIG. 31C is a perspective view of a heel compartment assembly including the articulated heel portion of FIG. 31A and the over-mold component of FIG. 31B.

Figure 32:
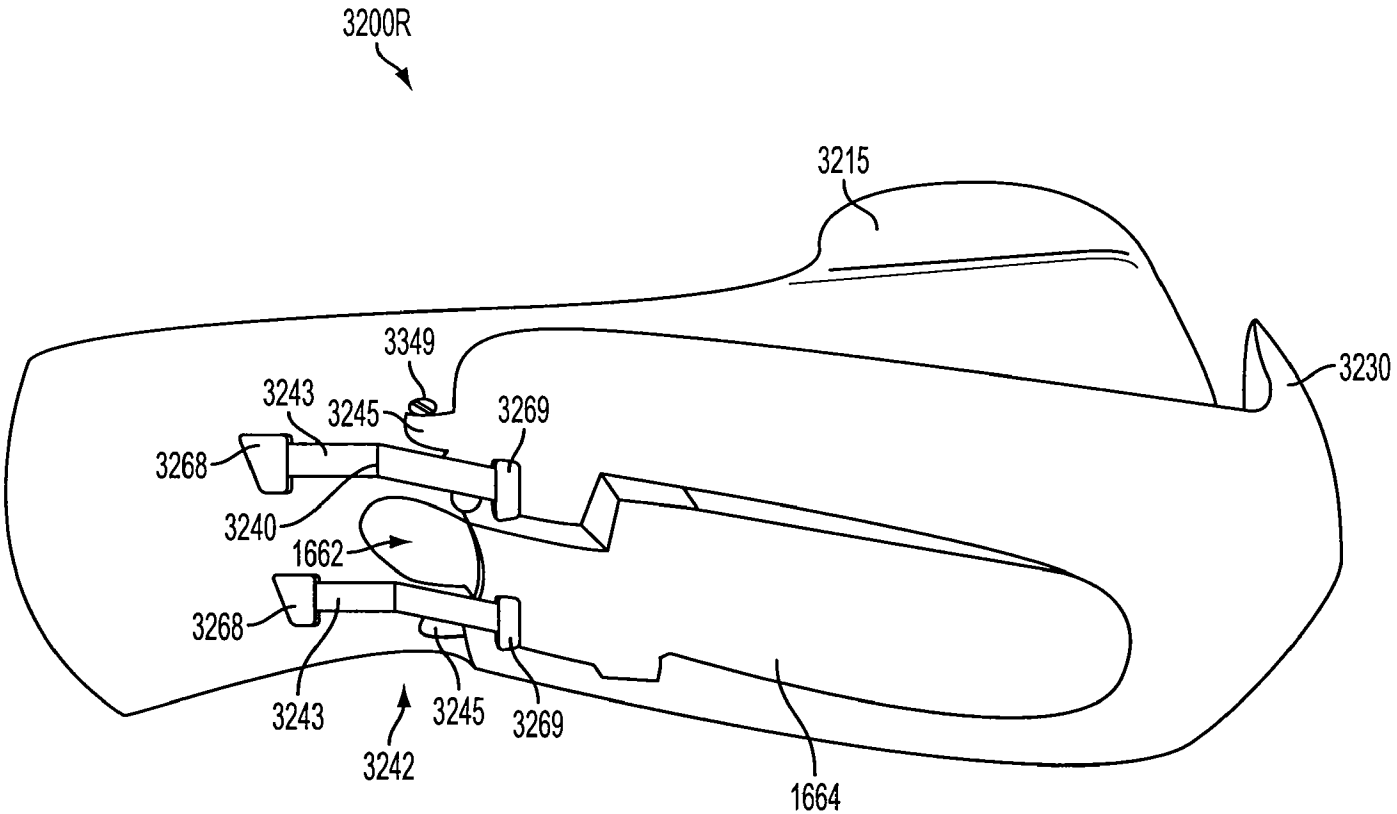

FIG. 32 is a perspective view of a heel compartment assembly according to another embodiment of the present invention.

Figure 33A:
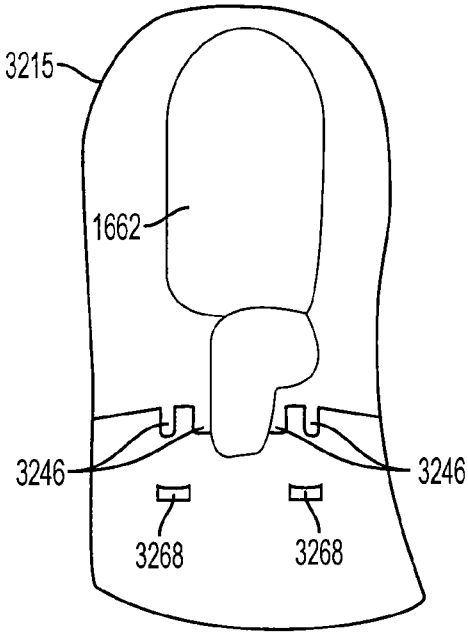

FIG. 33A is a bottom view of an inner counter of the heel compartment assembly illustrated in FIG. 32.

Figure 33B:
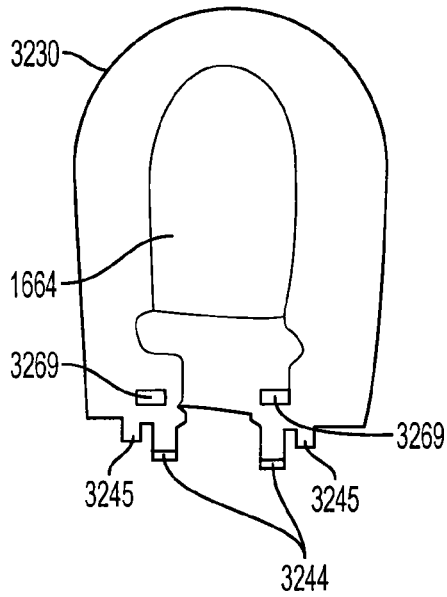

FIG. 33B is a bottom view of an outer counter of the heel compartment assembly illustrated in FIG. 32.

Figure 33C:
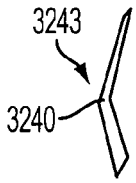

FIG. 33C is a side perspective view of a biasing means of a pivot mechanism of the heel compartment assembly illustrated in FIG. 32.

Figure 33D:
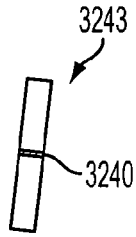

FIG. 33D is a front perspective view of a biasing means of a pivot mechanism of the heel compartment assembly illustrated in FIG. 32.

DETAILED DESCRIPTION OF THE INVENTION

Figure 1:
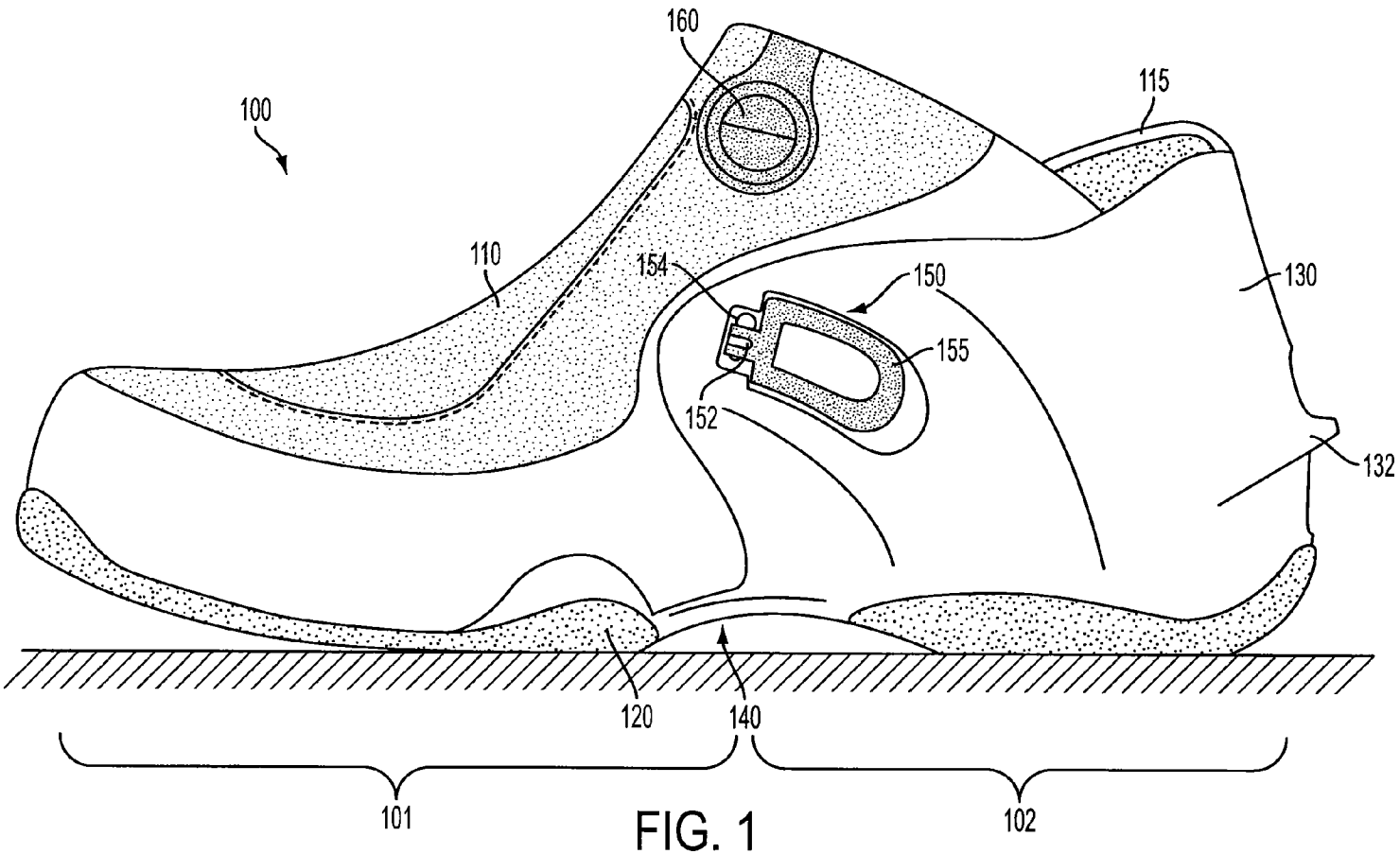
FIG. 1 is a lateral side of a shoe according to an embodiment of the present invention.
Figure 2A:
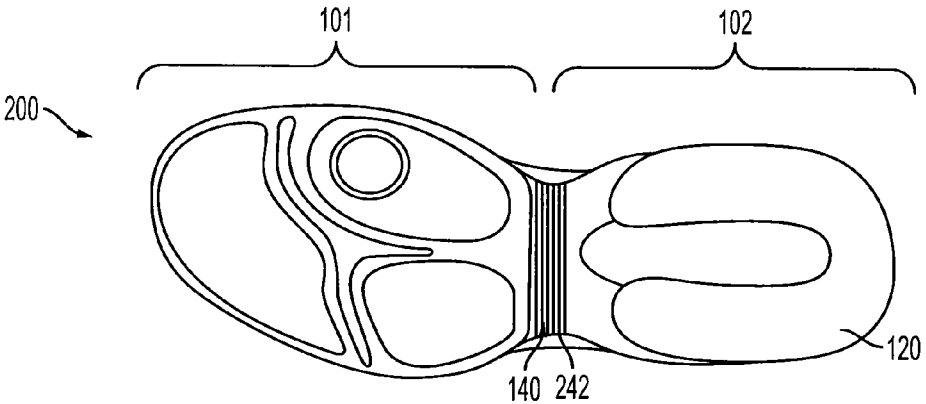
FIG. 2A is a bottom perspective view of a shoe according to another embodiment of the present invention.
Figure 2B:
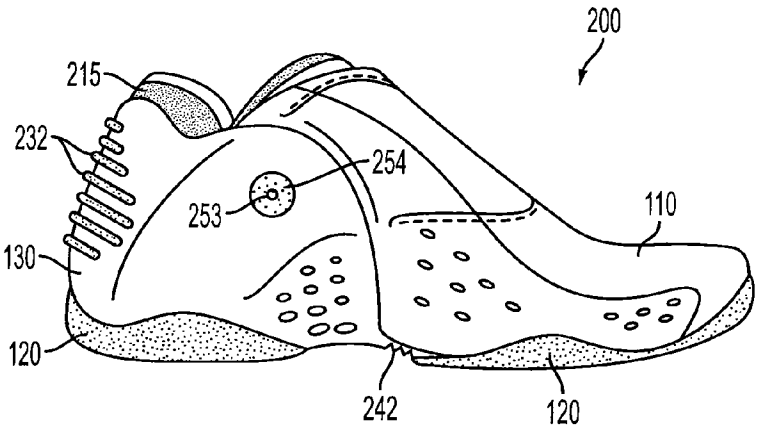
FIG. 2B is a medial side view of the shoe shown in FIG. 2A.
Figure 2C:
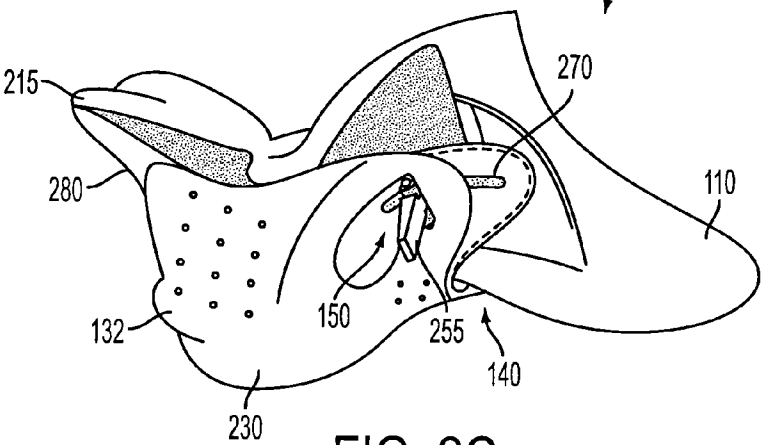
FIG. 2C is a medial side view of an alternate embodiment of the shoe of FIG. 2B showing a locking mechanism positioned on the medial side and released so that the shoe is in an open position.

A shoe 100 with an articulated heel portion to allow rear entry and exit of a user's foot, according to an embodiment of the present invention, is shown generally in FIG. 1. FIG. 1 is a lateral side view of shoe 100, which is for the left foot. The corresponding shoe for the right foot may be a mirror image of shoe 100 and therefore is not shown or described. Although the invention is shown herein as a shoe, it is intended that the present invention to be adapted for incorporation into other types of footwear such as boots, and also may be incorporated into a variety of types of athletic footwear, such as basketball shoes, running shoes, tennis shoes, soccer shoes, and specialty orthopedic shoes, for example. As shown in FIG. 1, shoe 100 has a forefoot area shown generally at 101, and a rear foot area shown generally at 102. Shoe 100 includes a sole 120 and an upper 110. At least a portion of upper 110 may have an inflatable bladder (not shown), stitched or otherwise connected to an interior or exterior surface of upper 110, to improve the fit system of shoe 100. In addition to securing the shoe around the user's foot with a locking mechanism 150, described below, the bladder may be inflated so that the shoe is snug around the user's foot. For example, inflatable bladders for shoes have been described at U.S. Pat. No. 7,047,670, incorporated herein by reference in its entirety. All embodiments described herein may incorporate an inflatable bladder in the upper to improve the shoe's fit. Further in this regard, shoe 100 may include an adjustable check valve for the inflatable bladder lining of upper 110. A release valve or a blow-off valve may also be provided on shoe 100, near the check valve, and the valves may be covered by a valve cover 160. The inflatable bladder may include an inflation mechanism such as a heel pump, or a hand pump near the location valve cover 160. An example blow-off valve or adjustable check valve position on a shoe upper is illustrated in FIG. 2F at 261.

Upper 110 further includes a heel piece 115, which forms a soft inner counter for the user's heel. As will be further described below with respect to a shoe 200 of FIGS. 2D-2F, heel piece 115 functions as a mechanical shoe horn to assist rear entry and closure of shoe 100 around a user's foot. A pivoting heel shell or cup 130 surrounds heel piece 115 and forms a generally rigid outer heel counter. For donning and doffing of shoe 100, heel shell 130 pivots at a pivot point 140 located between forefoot area 101 and rear foot area 102. A pivot mechanism is incorporated on heel shell 130, and is located generally at pivot point 140. Heel shell 130 may further include a tab 132 (formed in the shape of a wing in this embodiment), which provides a leverage point for the user to pivot heel shell 130 open for removal of shoe 100. Heel shell 130, pivot point 140 (and the pivoting mechanism), and tab 132 together provide an opening mechanism for rear entry shoe 100.

Shoe 100 further includes a locking mechanism 150, which secures shoe 100 in a closed position as shown in FIG. 1. Locking mechanism 150 includes a release member 155, which in this particular embodiment is a buckle or cam toggle 155. Toggle 155 is secured to a T-bolt 152 by an axle pin 154 and pivots at axle pin 154 from a closed position as shown in FIG. 1 to an open position (as shown in later described FIG. 2E). As shown in later described FIGS. 2C and 2E, arc-shaped lateral and medial slides 270 are fixed to upper 110. T-bolt 152 and a T-bolt 253 of the medial side (shown in FIG. 2B) are slidingly disposed through slide 270 (see, for example, assembly steps of FIG. 3B). The T-bolts may have between two to three millimeters of travel along slides 270. Slides 270 guide the movement of heel shell 130 relative to upper 110 as T-bolt's 152 and 253 move within the confines of slides 270. In the closed position (illustrated in FIG. 2D), slide 270 is hidden below heel shell 130 and in the open position (illustrated in FIG. 2E), in which heel shell 130 is pivoted away from upper 110, slide 270 is exposed.

In the closed position, slides 270 and heel shell 130 are drawn together by toggle 155. Raised bosses (not shown) are molded into the opposing, contacting surfaces of slides 270 and heel shell 130. When these surfaces are drawn together by toggle 155, opposing bosses interlock with each other, thereby securing the shoe 100 in the closed position.

Further details regarding an articulated heel portion of a rear entry shoe in accordance with the present invention are described with reference to FIGS. 2A-2F, in which like reference numerals are generally used to indicate identical or essentially similar elements as initially described with reference to shoe 100 of FIG. 1. FIG. 2A shows that the bottom view of a shoe 200 includes a pivot point 140 between rear foot area 102 and forefoot area 101. A pivot mechanism is located at pivot point 140. In this embodiment, the pivot mechanism is an axle hinge 242. Axle hinge 242 may be any type of pivoting hinge such as a mechanical hinge (shown in FIG. 16, for example), a composite hinge (shown in FIGS. 26A and 26B, for example), or a living hinge. FIG. 2A illustrates a living hinge 242 on shoe 200. Living hinge 242 may be formed of a single injection molded piece having a weakened area designed to bend at pivot point 140. In one embodiment, living hinge 242 is about 0.5 mm thick, and about 1.0 mm wide, but it should be apparent that a living hinge of another dimensions may be employed in accordance with the present invention. As shown in FIG. 2B, hinge 242 is adjacent a forefoot portion of sole at a shank area between rear foot area 102 and forefoot area 101, and is raised above the ground contacting surface of sole 120. In one embodiment, hinge 242 is integrally formed with heel shell 130 and is separate from the ground-contacting portion of shoe sole 120.

Toggle 155 may be included on either one of lateral or medial sides of the shoe, and also may be included on both sides of the shoe if desired. In the embodiment of shoe 200*c* illustrated in FIG. 2C, a toggle 255 provided on the medial side of the shoe. By contrast, on the medial side of shoe 200 illustrated in FIG. 2B, an opposing T-nut 254 having a circular flange is attached to an end of T-bolt 253 that extends through heel shell 130. On the lateral side of shoe 200, as shown in FIG. 2D, toggle 155 is attached to T-bolt 152.

Shoe 200 includes a heel piece 215 which is pulled back to provide a foot opening 203 (shown in FIG. 2F) when heel shell 130 is pivoted to the open position, thereby allowing for rear entry into shoe 200. FIG. 2F shows an outline of a rear portion 213 of upper 110 adjacent heel piece 215. Below rear portion 213 of upper 110 is a midsole 225 which is fixed to upper 110 and therefore does not rotate down with heel shell 130. Another example of a rear portion of an upper, heel piece, and midsole assembly is shown FIGS. 4A and 4B at 413, 415, and 325, respectively, and described in further detail below. A connector 280 has one end adhered to heel piece 215 and another end adhered to heel shell 130. When heel shell 130 is pivoted open, heel piece 215 is pulled back by connector 280. Connector 280 may be a nylon webbing constructed as a 10 mm wide strap and cemented or glued to heel shell 130. In the instance that shoe 130 is a hard plastic, connector 280 may be cemented or glued thereto. In contrast with the hard plastic of heel shell 130, heel piece 215 may be made of a soft, flexible material with a lining of padding, if desired, so as to form a soft shoe counter. Thus, connector 280 may be stitched to heel piece 215. If the material forming heel shell 130 is suitable for stitching, connector 280 may also be stitched to heel shell 130.

Figure 2D:
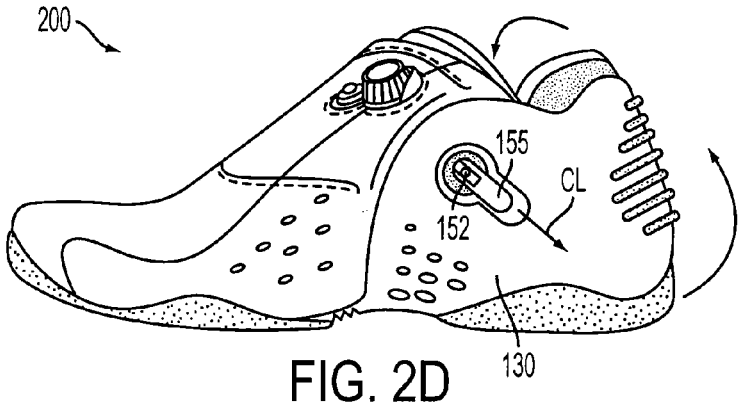
FIG. 2D is a lateral side view of the shoe of FIG. 2B showing movement of a heel portion into a closed and locked position.
Figure 2E:
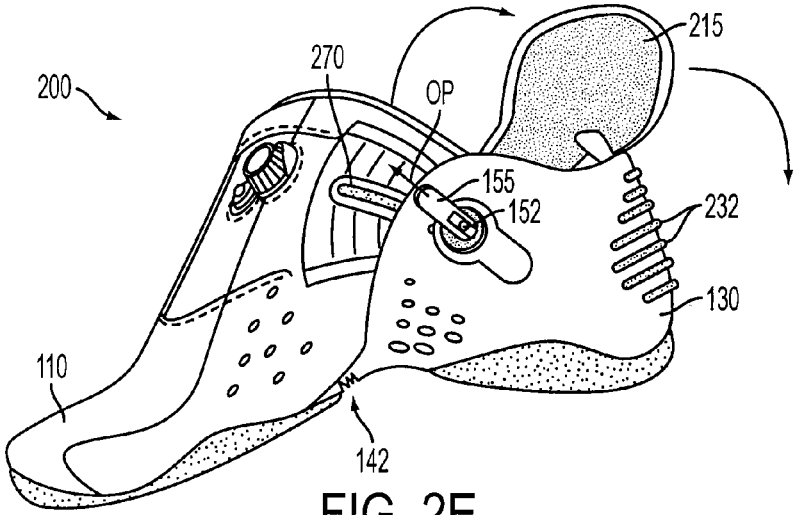
FIG. 2E is a lateral side view of the shoe of FIG. 2C showing movement of the heel portion into an open and unlocked position.
Figure 2F:
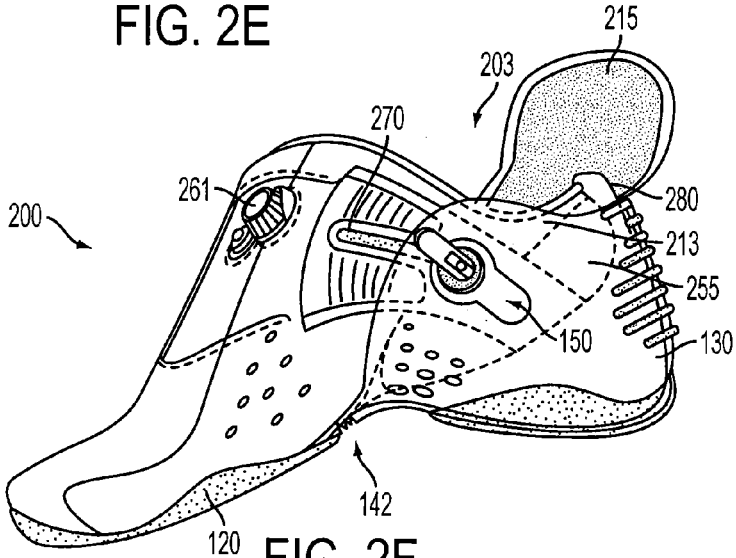
FIG. 2F is a lateral side view of the shoe of FIG. 2E showing an outlining of a heel piece of the upper pulled to an open position.

In operation, when shoe 200 is in the open position, as shown in FIGS. 2D and 2E (or FIG. 2C, for shoe 200*c*), a user inserts their foot in the foot opening just above rear portion 213 and presses their heel down on midsole 225, forcing midsole 225 further in heel shell 130. Heel shell 130 simultaneously pivots upward (illustrated by the arrows shown in FIG. 2D) into supporting engagement with heel piece 215. Heel piece 215 acts as a mechanical shoe horn to assist the user's heel into heel shell 130 as it pivots to the closed position. In this closed position, heel piece 215 is disposed between the heel of the foot and heel shell 130 and serves as a soft inner counter of shoe 200. Locking mechanism 150 is then used to retain shoe 200 in the closed position. By rotating toggle 155 down in the direction of arrow CL into a closed and locked position, so that toggle 155 now lies alongside heel shell 130, toggle 155 draws together heel shell 130 and upper 110 together, interlocking aforementioned bosses on the contacting surfaces of slides 270 and heel shell 130. The outer surface of heel shell 130 may also include a recess for holding toggle 155 so that toggle 155 is substantially flush with the shoe's outer surface.

In the removing operation of shoe 200, toggle 155 is pulled into an open position, shown by the direction of arrow OP in FIG. 2E. Heel shell 130 is thereby released from a locked position against upper 110, and T-bolt 153 (and T-bolt 253 of the medial side) may now slide freely within the confines of slides 270. Heel shell 130 may then be pivoted downward on hinge 142 to the open position, as illustrated by the arrows shown in FIG. 2E. As shown in FIG. 2F, heel shell 130 is rotated away from rear portion 213 (and midsole 225), simultaneously pulling back heel piece 215 via connector 280 so as to provide foot opening 203 for exit of the user's foot from the shoe.

Figure 3A:
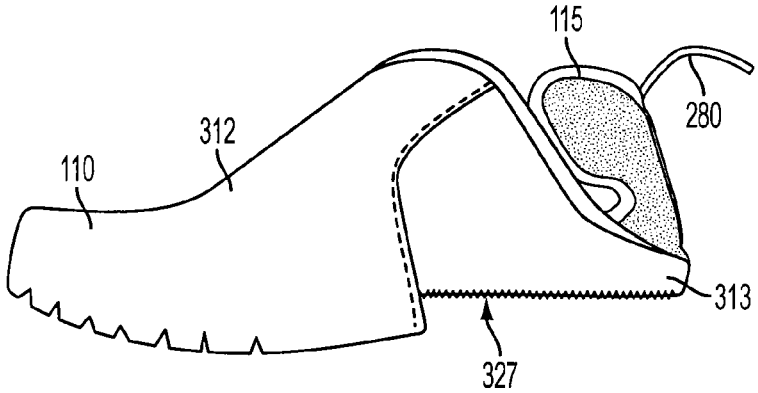
FIGS. 3A-3F are illustrations of exemplary assembly steps in the construction of a shoe according to an embodiment of the present invention.
Figure 3B:
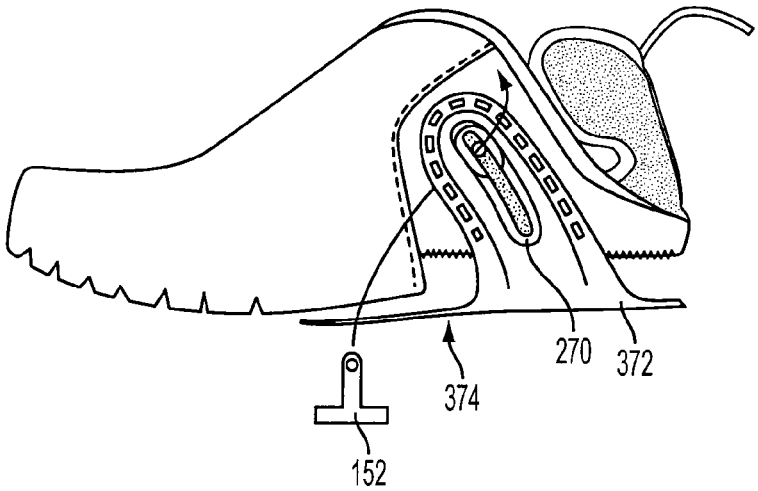
Figure 3C:
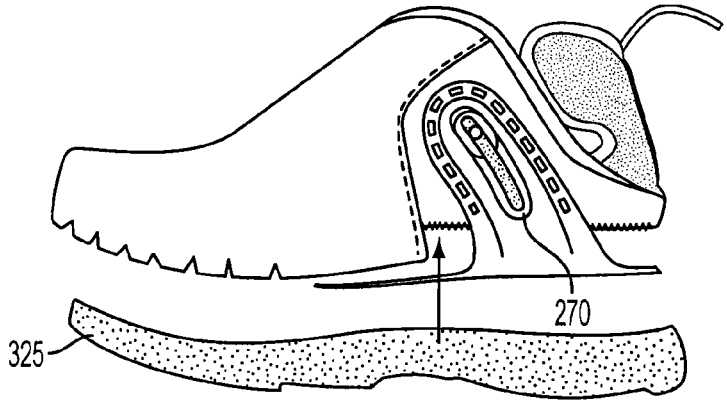
Figure 3D:
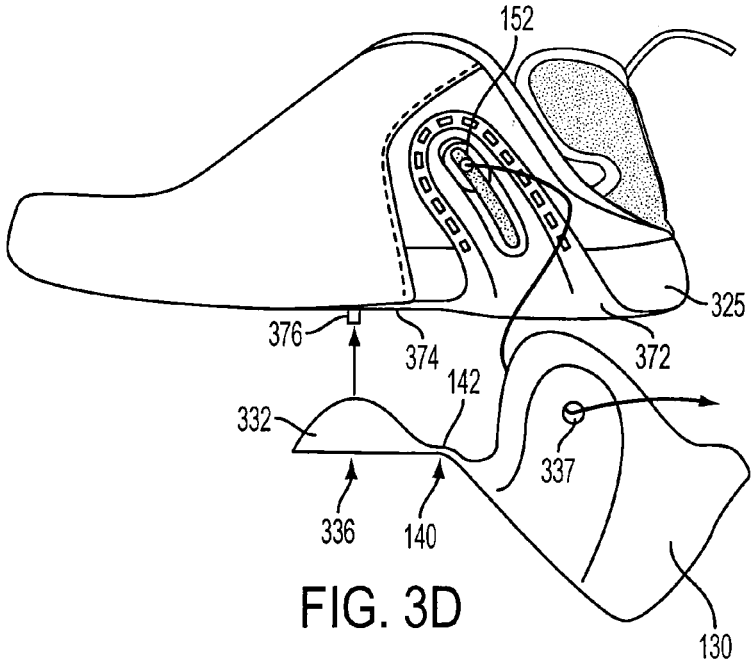
Figure 3E:
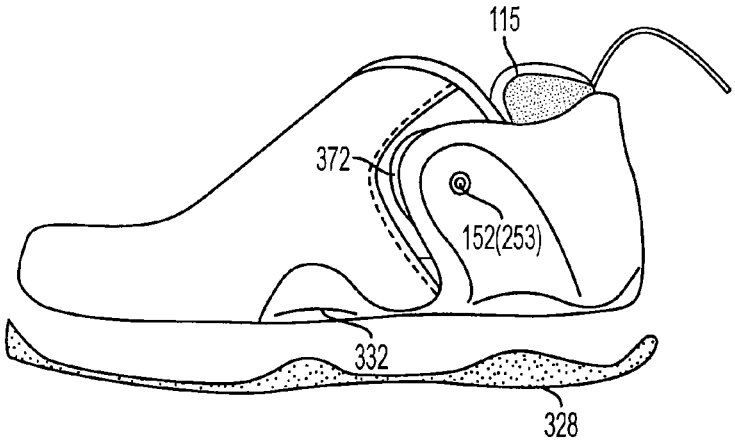

Exemplary steps of assembly of a shoe incorporating an articulated heel portion, such as shoes 100 or 200 (or 200*c*), will now be described with reference to FIGS. 3A-3F. In FIG. 3A, upper 110 is stitched to a strobel sock material 327 along its bottom in a known manner. Upper 110 includes a vamp 312 stitched, or otherwise connected to, rear portion 313, and heel piece 115 extends vertically from rear portion 313. Connector 280 adheres to an upper, rear portion of heel piece 115. Rear portion 313 may surround the rear end of heel piece 115, or alternatively, there may exist a rear cutout area (illustrated in FIGS. 4A and 4B at 414) so as to improve flexibility of heel piece 115 when it is pulled out from heel shell 130. In FIG. 3B, lateral and medial slides 270 are provided on a slide carrier 372, which may be formed as a single piece holding both lateral and medial slides or as two symmetrical lateral and medial pieces for holding respective lateral and medial slides. Slide carrier 372 is stitched, or otherwise connected to upper 110. T-bolt 152 (and T-bolt 253 of the medial side) are inserted through slides 270 prior to stitching. Slide carrier 372 has a bottom margin 374 for contacting the bottom surface of a midsole 325, which is disposed between strobel sock material 327 and bottom margin 374, as shown in FIGS. 3C and 3D. Midsole 325 is formed of a shock absorbent material, such as air filled pods or high density foam (for example, ethyl vinyl acetate (EVA)), as is known in the art. Midsole 325 is cemented to the upper, a toe area of the upper is lasted, and bottom margin 374 of slide carrier 372 is cemented down (or otherwise adhered) under midsole 325. Typically, an insole/sockliner (not shown) is positioned above midsole for contacting engagement with the foot.

As shown in FIG. 3D, heel shell 130 is secured to the shoe at a position forward of hinge 142 by an anchor portion 332. Hinge 142, anchor portion 332, and heel shell 130 may be integrally formed as a one-piece structure. Anchor portion 332 is cemented or otherwise securely attached to the slide, midsole and upper assembly. A hole or recess, generally at 336, provided on anchor portion 332, meshes with a stud 376 extending downwardly from bottom margin 374 of carrier 372, to guide positioning of heel shell 130 on the shoe. T-bolt 152 (and T-bolt 253) are inserted through openings 337 provided on each side of heel shell 130. With the shoe in the closed position shown in FIG. 3E, outsole 328 is cemented or otherwise securely attached to the bottom of the shoe assembly. Outsole 328 may be one-piece and cover the shank area where hinge 142 is disposed, or alternatively, may include a forefoot piece and a rear foot piece, with hinge 142 remaining exposed, similar the configuration of sole 120 of shoe 200 described above.

Figure 3F:
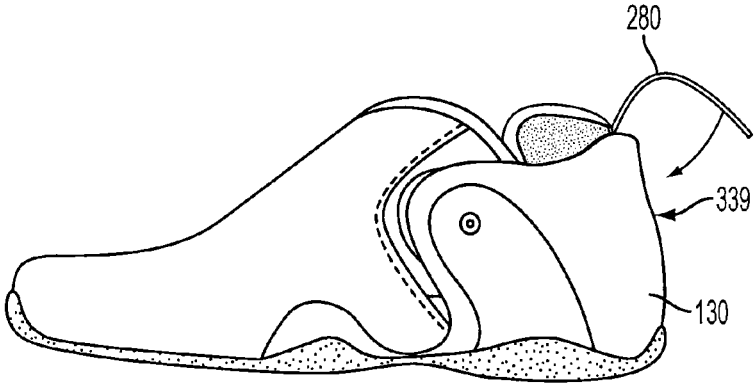

As suggested in FIG. 3F, connector 280 is cemented or otherwise securely attached to an inside rear surface of heel shell 130. A recess shown generally at 339 may be provided on the inside surface of heel shell 130 for holding connector 280 flush along the inside surface of heel shell 130. Alternatively, connector 280 may be cemented or otherwise securely attached to an outside surface of heel shell 130, and recess 339 may likewise be on the outside surface for holding connector 280 substantially flush along the outside surface of heel shell 130. Though not illustrated, on at least one of the lateral and medial sides, a toggle or other release member 155 is attached to T-bolt 152 (or T-bolt 253 of the medial side) extending through openings 337 of heel shell 130, by means of axle pin 154, as shown above with respect to FIG. 1. Axle pin 154 may be inserted through toggle 155 when toggle 155 is in the open position and unlocked position illustrated in FIG. 2C or 2E.

Figure 4C:
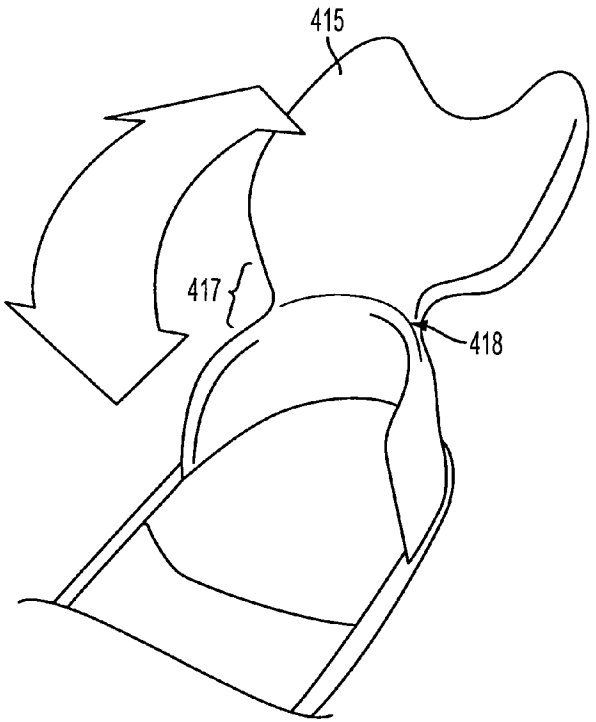
FIG. 4C is an elevation perspective view of the heel piece of FIGS. 4A and 4B illustrating pivoting of the heel piece to the open position.
Figure 4A:
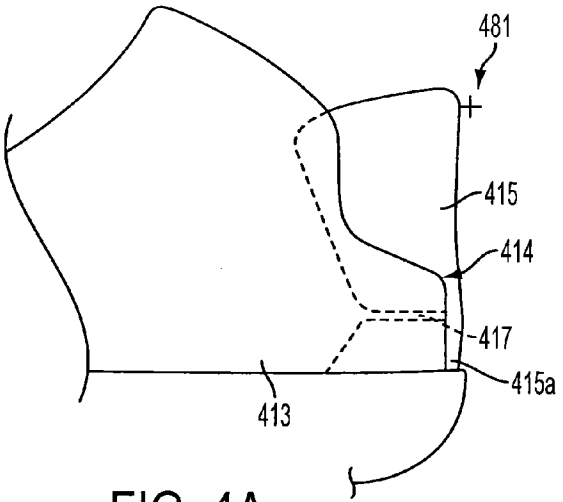
FIG. 4A is a side view of a heel piece of the upper in a closed position.
Figure 4B:
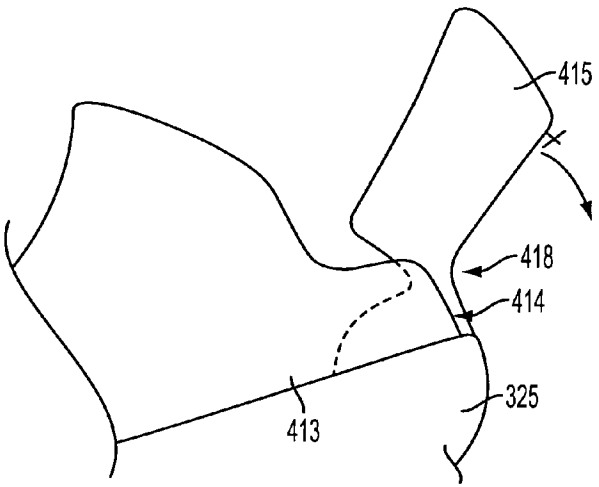
FIG. 4B is a side view of the heel piece of FIG. 4A shown in an open position.
Figure 7A:
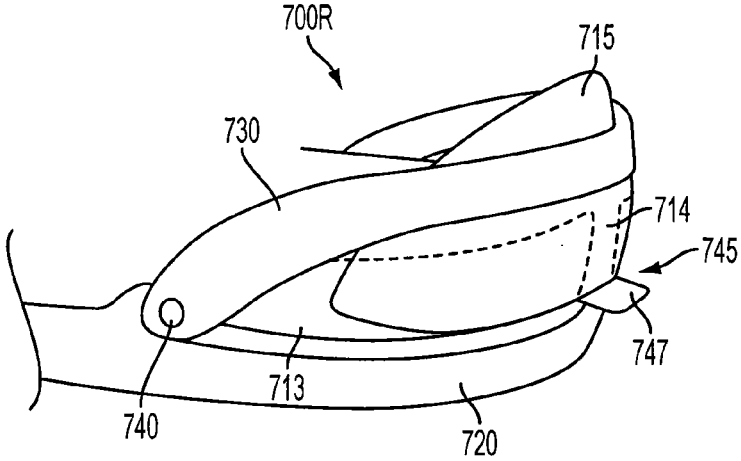
FIG. 7A is a side perspective view of a shoe heel compartment according to an embodiment of the present invention.

FIGS. 4A to 4C illustrate details of a heel piece 415 pivoting from a closed position (shown in FIG. 4A) to a pulled back position (shown in FIGS. 4B and 4C). In these figures, heel shell 130 is not shown. Heel piece 415 may be stitched to earlier described strobel sock material 327, and a lower portion 415*a* of heel piece 415 may also be stitched to a rear portion 413 of the upper. In this particular embodiment, rear portion 413 of the upper includes a heel cutout area 414, which divides rear portion 413 into two symmetrical lateral and medial pieces. A rear view of a heel cutout area 714 similar to heel cutout area 414 is illustrated in FIG. 7A. Heel piece 415 may include a detached section 417 shown in FIGS. 4A and 4C for improving flexibility and pivoting of heel piece 415. Thus, the combination of a heel cutout area 415 and detached section 417 facilitate flexing of heel piece 415 from the closed position to the pulled back and open position. In an alternative embodiment, rear portion 413 and heel piece 415 are assembled as one piece, with no cutout area 414 and with heel piece 415 extending vertically from rear portion 413. While this alternative design may provide ease of manufacture, heel piece 415 is more restricted in its ability to pivot from its upright and closed position to the pulled open position. This configuration is illustrated for another embodiment of a shoe in FIG. 11.

Heel piece 415 is pulled back at a point 481 at which connector 280 (not shown) may be attached to heel piece 415. As it is being pulled back, heel piece 415 pivots at a pivot point 418 so as to deform from an upright position near rear portion of upper 413 to an rearward, angled position away from rear portion of upper 413. FIG. 4B shows rear portion 413 of the upper and midsole 325 angled upward from horizontal, so as to illustrate that midsole 325 is spaced from a heel shell (not shown) in the open position, as earlier described above with respect to FIG. 2F. In the pulled back position, heel piece 415 operates as a mechanical shoe horn to allow rearward entry of the user's foot and to assist in return of heel shell 130 to the closed position.

Figure 5A:
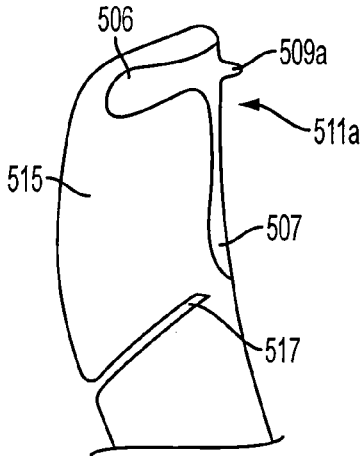
FIGS. 5A-5C are perspective views of three respective embodiments of a reinforcement member for attachment to the heel piece of the upper.
Figure 5B:
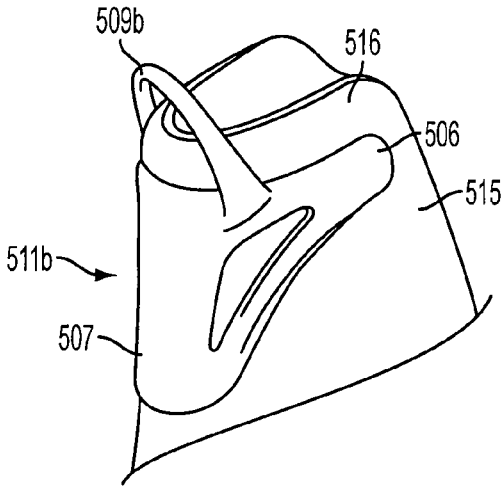
Figure 5C:
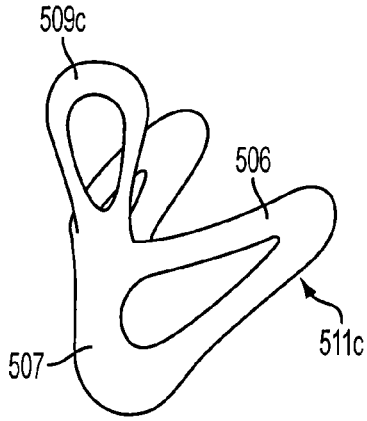

A reinforcement element 511*a*, 511*b* or 511*c* illustrated in FIGS. 5A-5C may be provided on any of the previously described heel pieces of shoes 100 or 200. Reinforcement elements 511*a*, 511*b* and 511*c* are disposed on an upper, rear portion of a heel piece 515 formed of a soft, flexible material. Reinforcement elements 511*a*, 511*b* and 511*c* provide stiffness to heel piece 515, helping heel piece 515 maintain its shape when it is returned to an upright position supported by heel shell 130. FIGS. 5A-5C provide examples of different structures of reinforcement elements; however, other structures serving the same function may be used, as would be apparent to one of ordinary skill in the art. In FIG. 5A, a cutout portion 517 is provided on heel piece 515 to assist in the flexibility of heel piece 515 from the closed to the open, pull back position (not shown here). In FIG. 5B, reinforcement element 511B is disposed just below a collar 516 on heel piece 515. Each of reinforcement elements 511*a*, 511*b* or 511*c*, may include a side tab 506 extending laterally around heel piece 515 and a perpendicular tab or spine tab 507 extending vertically down a rear portion of heel piece 515. In addition, these reinforcement elements may include a back tab 509*a*, 509*b*, or 509*c*, as shown in FIG. 5A, 5B, or 5C, respectively. The combination of back tab 509*a*, 509*b*, or 509*c* with side tab 506 and spine tab 507 provides rigidity to the upper portion of heel piece 515, improving the mechanical shoe horn function of heel piece 515 during rear entry of the user's foot into the shoe, as described earlier. Back tabs 509*b* and 509*c* extend above collar portion 516 (shown in FIG. 5B), thereby providing added protection for the Achilles tendon area of a users foot when the shoe is worn.

Figure 6:
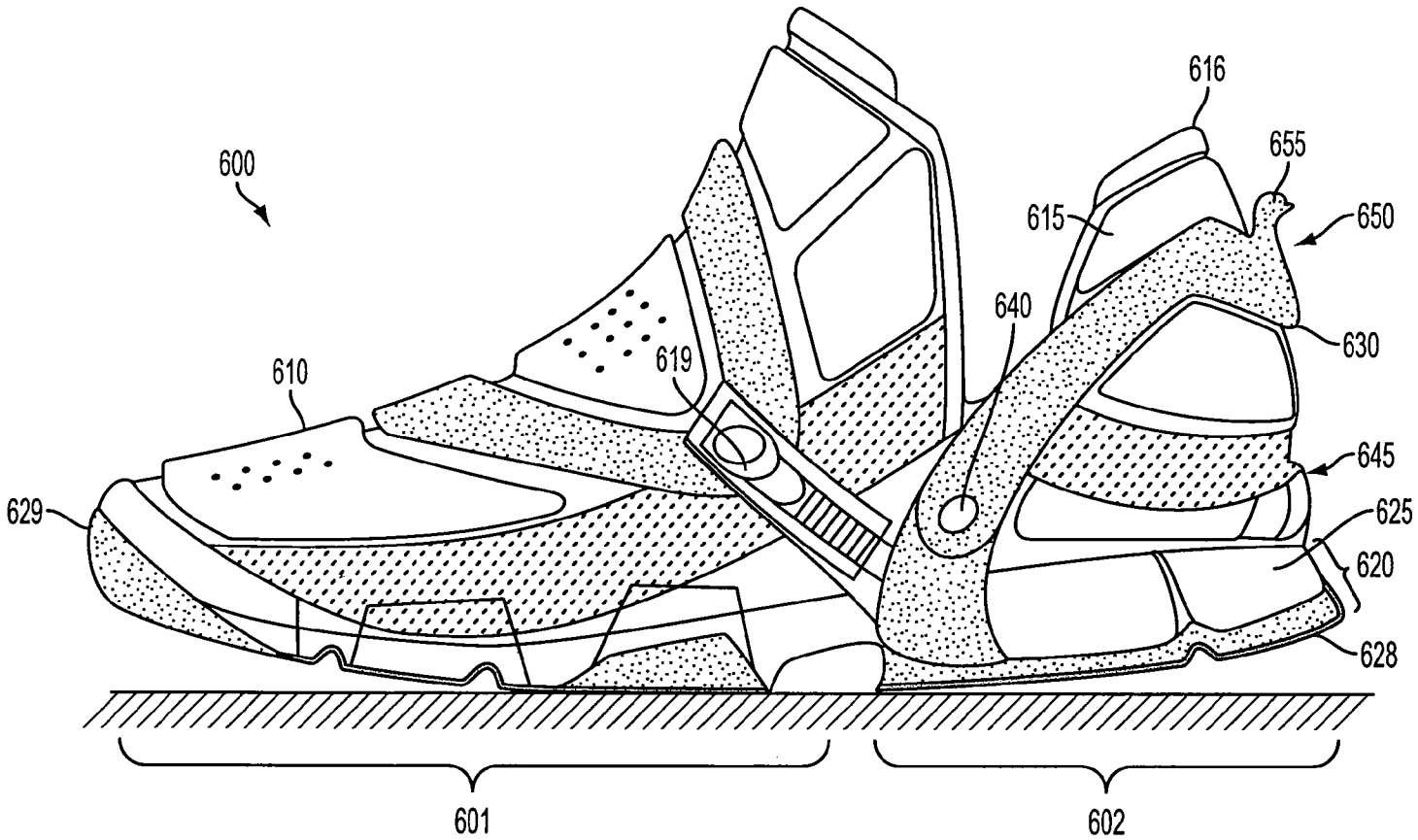
FIG. 6 is a lateral side view of a shoe according to another embodiment of the present invention.

FIG. 6 illustrates another embodiment of a rear entry shoe 600, in accordance with the present invention. Shoe 600 has a rear portion that pivots substantially away from enclosing the rear of shoe 600, so that the shoe resembles a mule for easy rear entry and removal. Shoe 600 includes a forefoot area shown generally at 601 and a rear foot area shown generally at 602. A shank area of shoe 600 is at the intersection of the forefoot and rear foot areas. Shoe 600 includes a sole 620 and an upper 610, which may include a vamp strap 619. Vamp strap 619 has a buckle, Velcro, or other fastening device to hold vamp strap 619 across the top of shoe 600 at a desired tightness selected by a user to obtain improved fit. Sole 620 includes a midsole 625 and an outsole 628, and may further include a toe cap 629 to provide added protection and durability to the toe area of the shoe.

In this embodiment, a first pivot point 640 is located in rear foot area 602, instead of at the shank area disposed between forefoot area and rear foot area 602. In an alternative embodiment, as described below, shoe 1000 shown in FIG. 10 includes a pivot point 1040 located at the shank area of the foot, similar to pivot point 140, at the shank area of shoe 100 of FIG. 1. Further, unlike shoe 100 of FIG. 1, pivot point 640 does not extend across the base of the shoe; rather, a lateral and medial side pivot point 640 are provided on a perimeter the shoe sole, similar to the embodiment shown in FIGS. 7B and 7C, described below, in which a lateral and medial side pivot point 740 are provided on a perimeter rim 735 of a shoe sole. A heel support lever 630 is pivotally attached on the lateral and medial side of shoe 600 at pivot point 640 and serves as a mechanism for opening and closing the rear of shoe 600. A heel counter 615 is pivotally attached to shoe at second pivot point 645. Heel support lever 630 pivots from an upright, or closed, position shown in FIG. 6 to a down, or open, position (not shown here) that is below second pivot point 645. In the upright position, heel support lever 630 serves as an outer heel counter in abutting engagement with counter 615. When heel support lever 630 is moved to the down position, counter 615 is pivoted to an open, approximately horizontal position (see FIG. 7D, for example) to allow rear entry of a user's foot into shoe 600. Heel support lever 630 returns counter 615 to its closed, upright position when heel support lever 630 pivots upward at pivot point 640 to be in supporting, abutting engagement with counter 615. In this embodiment, counter 615 is a generally rigid, arc-shaped structure, extending vertically around the heel of the foot, and may further include a soft collar 616 along its top perimeter. In this embodiment, heel counter 615 is substantially exposed along an outer surface of shoe 600, but for that portion supported by heel support lever 630.

Shoe 600 further includes a locking mechanism 650 for retaining counter 615 and heel support lever 630 in abutting engagement in the upright position. Locking mechanism 650 may include a release member 655 (shown here in the form of a tab) that allows the user to release heel support lever 630 from its secured position against counter 615 and pivot heel support lever 630 and counter 615 downward for opening the rear of shoe 600. An exemplary embodiment of a locking mechanism employing a release member is shown and later described with reference to FIG. 9.

Further, a pivot mechanism may be provided at pivot point area 640 to include a biasing means which biases heel support lever 630 in the opened or closed position, depending on the chosen design. For example, a spring-loaded hinge may be provided on lateral and medial sides at pivot point 640 to bias heel support lever 630 in an upright and closed position. In this instance, a locking mechanism 650 may not be necessary to maintain counter 615 and heel support lever 630 in the closed position. Alternatively, heel support lever 630 may be biased in the open position, such that when heel support lever 630 is released from locked engagement with heel piece 615 (i.e., release member 655 is actuated), it automatically moves downward to the open position.

Further, heel support lever 630 can be configured to pivot counter 615 to the open position when lever 630 moves past second pivot point 645, thereby automating the opening of the rear of shoe 600 for easy removal. An example of such a configuration is illustrated in FIG. 7A, which shows a heel compartment assembly 700R of a shoe. A heel support lever 730 surrounds a heel counter 715, and a flange 747 is fixed at a bottom rear of counter 715. When heel support lever 730 is pivoted downward at pivot point 740, it engages flange 747, thereby actuating and pivoting counter 715 open at second pivot point 745. Thus, heel support lever 730 and counter 715 are pivoted downward toward a sole 720, and the rear of the shoe is opened for easy entry and exit of the user's foot. Further, movement of counter 715 at pivot point 745 may be improved by means of cutout portion 714 in a rear portion 713 of upper, in a similar manner as that described above in the embodiments of FIGS. 4A and 4B.

Figure 7B:
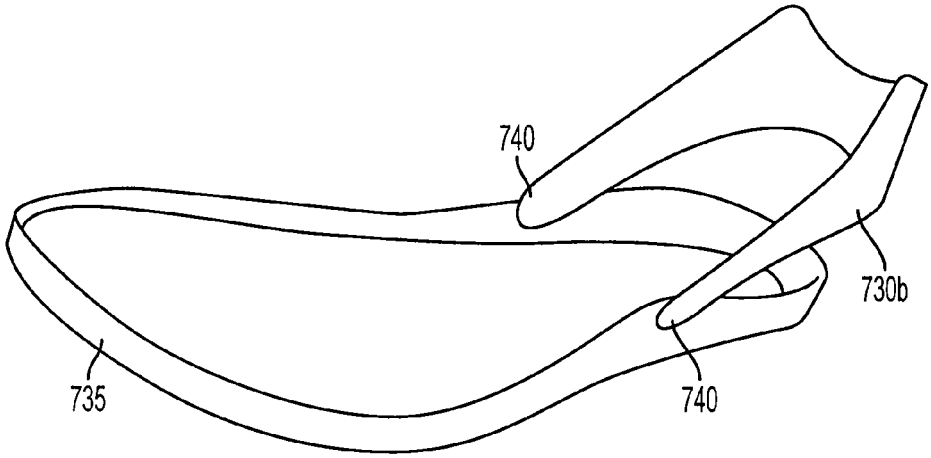
FIG. 7B is a perspective view of a heel support lever hinged to a rim of a sole according to an embodiment of the present invention.
Figure 7C:
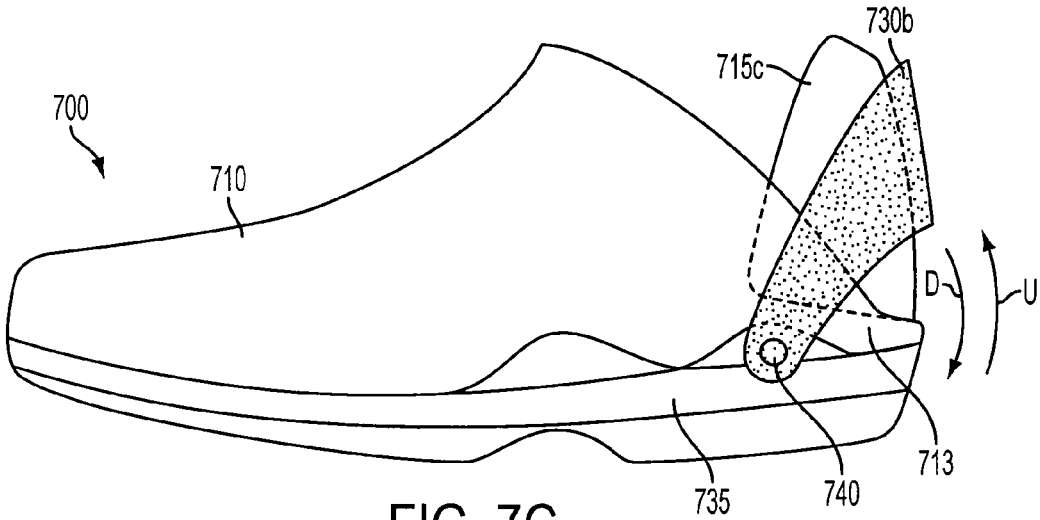
FIG. 7C is a side view of a shoe incorporating the heel support lever and rim of FIG. 7B.

FIG. 7B is a perspective view of a heel support member 730*b* pivotally adhered to a rim 735 at lateral side and medial side pivot points 740. FIG. 7C is a lateral view of rim 735 surrounding the periphery of sole 720 of a shoe 700, with heel support member 730*b* pivoted upward in the direction of arrow U, so as to be in supporting engagement with a counter 715*c*. Depending on its manner of attachment to shoe 700 and whether lever 730*b* is biased in direction of arrows D or U, counter 715*c* may be moved in a downward position by the user, lever 730*b*, and/or force of gravity. If heel support lever 730*b* is biased in the direction of arrow U by a biasing means of a pivot mechanism (e.g., a spring hinge), the user would force heel support lever 730*b* in the direction of arrow D to pivot it downward against bias of the biasing means. When lever 730*b* is released by the user, lever would automatically return to the upright and closed position under bias of the biasing means and would also force counter 715*c* to the closed position.

When counter 715*c* and heel support lever 730*b* are rotated down in the direction of arrow D, the shoe opens up and resembles a clog or mule in which a rear portion 713 of an upper 710 may receive the user's foot without obstruction of counter 715*c* and heel support lever 730*b*. In one embodiment, a locking means for locking heel support lever 730 in the down and open position may be provided. For example, in a manner that should be apparent to one skilled in the art, a pawl and a ratchet wheel may be provided on an axle of either the lateral or medial side pivot point 740 retaining heel support lever 730 down in the open position. In this instance, a release button or other release member may be actuated by the user to release the pawl from locking engagement with the ratchet to permit automatic return of heel support lever 730 in its upright, closed position, by virtue of the biasing means.

Figure 7D:
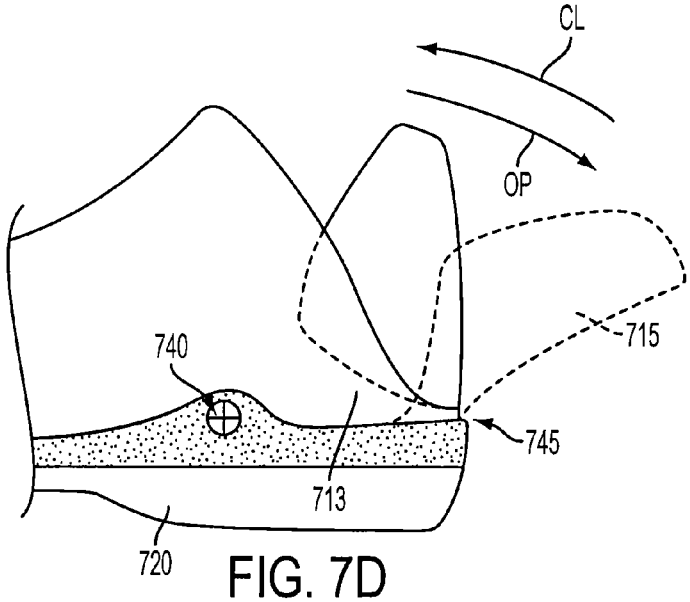
FIG. 7D is a side view of a heel portion of the shoe shown in FIG. 7C, with the heel support lever removed, and showing closed and open positions of a heel counter.

FIG. 7D is a side view of a heel portion of shoe 700 (with heel support lever 730*b* removed), illustrating a schematic of counter 715*c* pivoting at pivot point 745. Counter 715*c* pivots to the open position in the direction of arrow OP and pivots to the closed position in the direction of arrow CL. Counter 715*c* overlaps rear portion 713 of the upper either along the upper's interior surface. In one embodiment, the counter overlaps an external surface of rear portion 713. For example, counter 715 of FIG. 7A surrounds an external surface of rear portion 713 of the upper. Likewise, a counter 815 of FIG. 8 surrounds an external surface of a rear portion of the upper.

Figure 8:
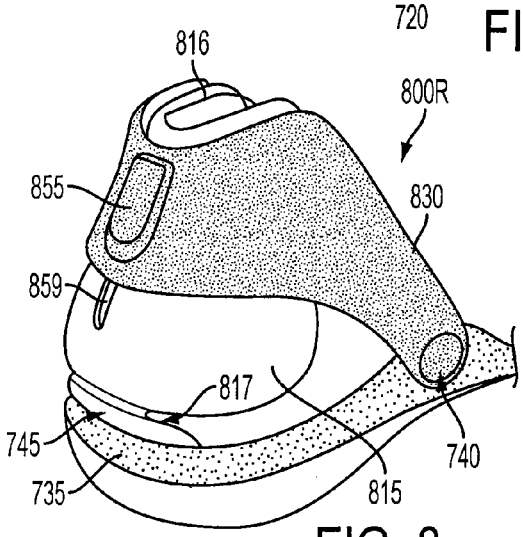
FIG. 8 is a rear perspective view of a shoe heel compartment assembly according to another embodiment of the present invention.

FIG. 8 shows a rear perspective view of an alternative embodiment of a heel compartment assembly 800R for a shoe according to the present invention. In contrast to the heel compartment assembly of shoe 600, heel compartment assembly 800R includes a heel support lever 830 carrying a release member 855 configured as a button switch, instead of as a tab like release member 655. Further, in this embodiment, heel support lever 830 is greater in width than heel support lever 630, and therefore is similar in this regard to heel support lever 730*b*. As discussed above, biasing means (not shown) in the area of pivot point 740 may bias heel support lever 830 in either an upward (closed) or downward (open) position. In either case, a locking mechanism is provided to ensure heel support lever 830 in maintained in its upward and closed position in supporting engagement with a heel counter 815 disposed around a user's heel. Further, heel support lever 830 may be positioned so as to substantially surround the upper portion of counter 815 adjacent a collar 816, rather than being situated further below the collar, as are heel support levers 630 and 830 of shoes 600 and 1000 illustrated in FIGS. 6 and 10, respectively. As such, it may be preferred to incorporate heel compartment assembly 800R in a high top athletic shoe to provide greater heel and ankle support.

Counter 815 includes a detached section 817, similar to detached section 417 described with reference to embodiments shown in FIGS. 4A-4C of heel piece 415. Detached section 817 provides counter 815 with greater flexibility to pivot to the open position at pivot point 745. Along the rear of counter 815 is a longitudinal slot 859 provided in rear of counter 815. Similar to later described locking mechanism 950 of FIG. 9, release member 855 may be connected to a pawl extending through slot 859 to selectively disengage a ratchet tooth extending in slot 859. Heel support lever 830 may then slide freely up or down relative to counter 815 along slot 859. When heel support lever 830 slides downward and reaches the end of its track along slot 859, further downward movement pulls counter 815, causing counter 815 to pivot at second pivot point 745 to the open position.

Figure 9:
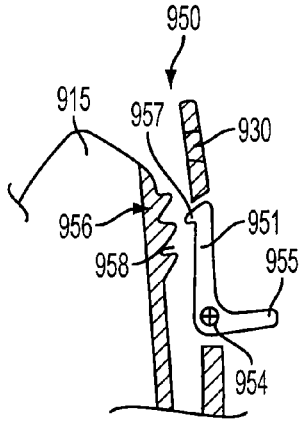
FIG. 9 is an expanded partial cross-sectional view of a locking mechanism for selectively locking a heel support lever in supporting engagement with a heel counter, according to an embodiment of the present invention.

An example embodiment of a locking mechanism for retaining a heel support lever, such as levers 830 or 630, in an upward and locked position is shown in FIG. 9. FIG. 9 shows an expanded partial cross section of a heel counter 915 and a heel support lever 930. In this embodiment, a locking mechanism 950 includes a ratchet and pawl assembly, wherein in a pawl 951 is disposed on heel support lever 930 and a ratchet 956 is disposed on counter 915. Ratchet 956 may include one or more tooth recesses 958 for receiving a tooth 957 provided on pawl 951. Ratchet 956 may extend along a slot in a counter, such as slot 859 shown in FIG. 8. A release member 955 (shown here as a tab) is fixed to pawl 951 and projects outwardly from heel support lever 930. Pulling down on release member 955 causes it to pivot at an axis of rotation 954 and correspondingly rotates pawl 951 away from engagement with teeth of ratchet 956, removing tooth 957 of pawl 951 from tooth recess 958 of ratchet 956. Release member 955 may be spring loaded to bias pawl 951 to engage ratchet 956. Release member 955 may alternatively be formed as a button switch, such as button switch 855 shown in FIG. 8, or other structure that when actuated disengages locking mechanism 951 so as to decouple heel support lever 930 from counter 915.

Figure 10:
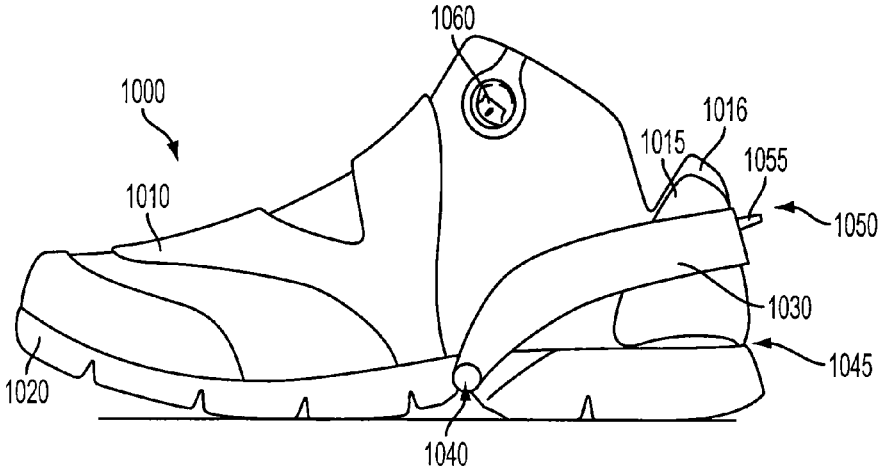
FIG. 10 is a lateral side view of a shoe according to another embodiment of the present invention.

FIG. 10 shows a side view of a shoe 1000, which is an alternative embodiment of shoe 600, wherein a pivot point 1040 for a heel support member 1030 is disposed at a shank area of the shoe between a rear foot area and a forefoot area, as opposed to being disposed at the rear foot area of the shoe as provided in shoe 600 of FIG. 6. In this embodiment, a pivot mechanism at pivot point 1040 may extend the width of a sole 1020 between the lateral and medial sides, so as to be hinged to a bottom of sole 1020 without the use of rim 735 shown in FIG. 7B. For example, a mechanical hinge may be used to connect heel support lever 1030 to sole 1020. Similar to shoe 600 of FIG. 6, the shoe 1000 includes an upper 1010 which includes an exposed heel counter 1015 with a soft collar portion 1016. Disposed on upper 1010 is a valve cover 1060 for a check valve of an inflatable bladder lining attached to upper 1010, similar to valve cover 160 discussed above with respect to the shoe 100 of FIG. 1. Shoe 1000 further includes a locking mechanism 1050, which may be configured as the ratchet and pawl assembly described with reference to FIG. 9. Shoe 1000 includes a release member 1055 in the form of a tab for releasing heel support lever 1030 from supporting engagement with counter 1015. Heel support lever 1030 and counter 1015 pivot down along pivot points 1040 and 1045, respectively, to fully open the rear of shoe 1000 for rear foot entry or removal.

Figure 11:
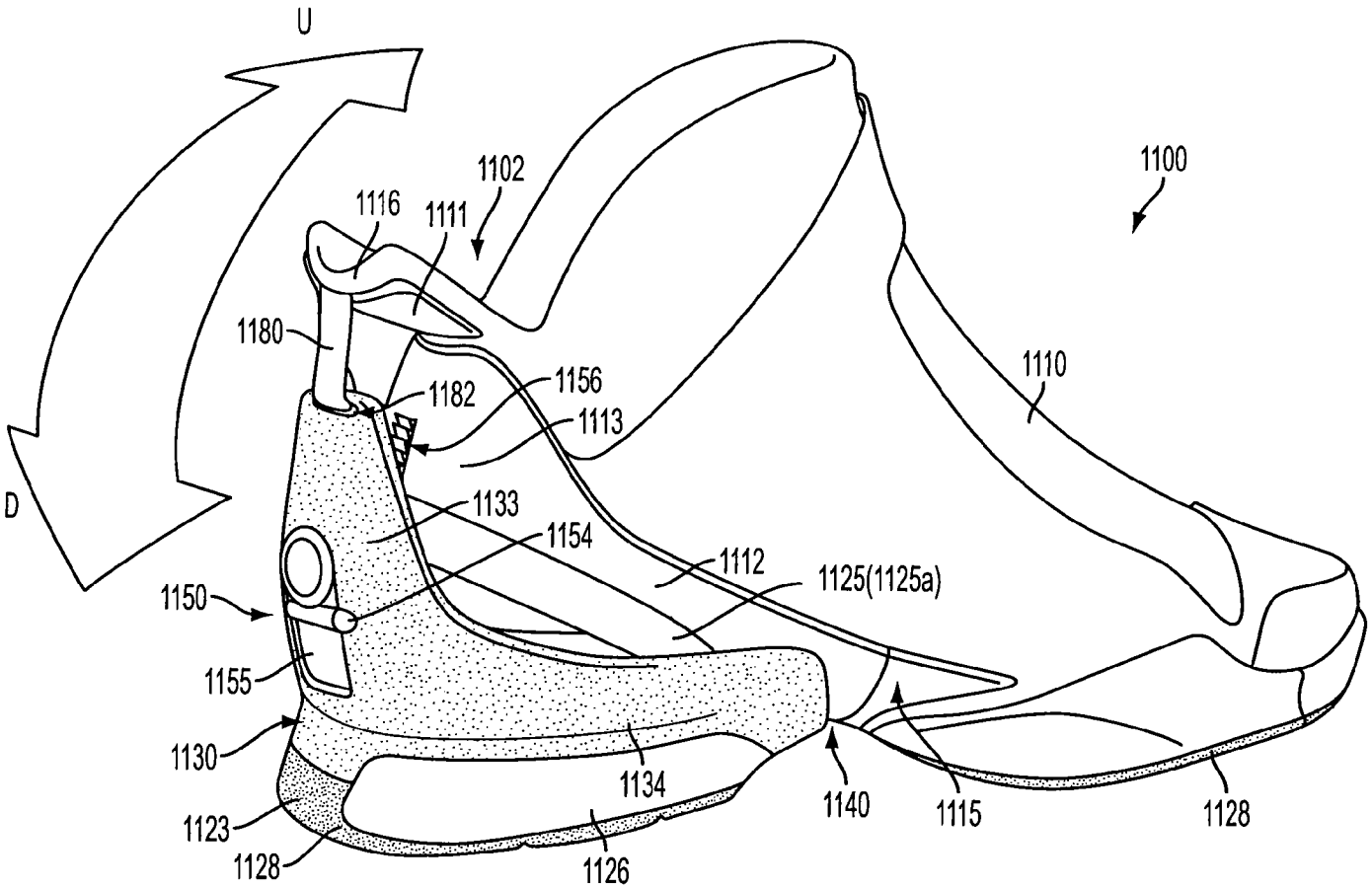
FIG. 11 is a lateral side view of a shoe according to another embodiment of the present invention.

FIG. 11 shows a lateral side view of another embodiment of a shoe according to the present invention. A shoe 1100 includes a full foot midsole 1125 that is cemented, or otherwise secured to, an upper 1110. A rear foot portion of upper 1110 has a generally rigid, arc-shaped inner counter 1115, which includes a vertically extending rear heel portion 1113 and lateral and medial side members 1112 (later described with reference to FIGS. 13A and 13B) that extend longitudinally from rear heel portion 1113 along the lateral and medial sides of shoe 1100. In this embodiment, an opening is formed along a bottom of inner counter 1115 (see, for example, an opening 1201 in an inner counter 1215*a*, shown in FIG. 12A). A rear portion 1125*a* of full foot midsole 1125 fills this opening bed and is framed along its upper periphery by inner counter 1115. Rear portion 1125*a* and inner counter 1115 together form an inner heel cup. Rear portion 1125*a* is visible below the lower edge of inner counter 1115. Shoe 1100 further includes an outsole 1128 separated into a forefoot portion and a rear foot portion with a pivot point 1140 there between. Outsole 1128 includes a vertically extending heel cap 1123, which covers a rear end portion of a rear foot midsole 1126. Rear foot midsole 1126 is joined to an outer counter 1130. Similar to heel shell 130 of the embodiment of FIG. 1, outer counter 1130 includes a vertically extending, generally rigid outer rear heel portion 1133, and may further include lateral and medial side members 1134 extending longitudinally from rear heel portion 1133. Outer counter 1130 may further include a shank member and a bottom member (such as, for example, a shank member 1236 and a bottom member 1237 shown in FIG. 12A), thereby forming a generally rigid outer heel cup.

A collar of upper 1110 has a rear portion 1116 to which is fixed a connector 1180 that couples rear portion 1116 of the collar to outer counter 1130 at its upper rear end opposite from heel cap 1123. Connector 1180 is looped through a ring opening 1182 provided in outer counter 1130. It should be apparent that ring opening 1182 may be provided on the inside vertical surface of outer counter 1130 so as to be hidden from view. In another embodiment, recesses may be provided on a surface of outer counter 1130 and connector 1180 is cemented therein, similar to the mounting of connector 280 to heel shell 130, described above with reference to FIG. 3F. A reinforcement member 1111 is fixed to upper 1110 just below rear portion 1116 of the collar and spaced from an upper rim of inner counter 1115, to allow rear portion 1116 of the collar and reinforcement member 1111 to flex relative to inner counter 1115 when connector 1180 is pulled by outer counter 1130, as shown in FIG. 11.

Shoe 1100 is provided with a pivot mechanism (not shown) permitting outer counter 1130 to pivot relative to inner counter 1115 at pivot point 1140. In this embodiment, outer counter 1130 (as well as adjoined rear foot midsole 1126 and rear foot portion of outsole 1128) is biased in an open position as shown in FIG. 11 in which shoe 1100 may be put on or removed from a user's foot. In one embodiment, pivot mechanism may be a mechanical hinge, such as a mechanical hinge 1642 described with reference to FIG. 16, and in another embodiment, the pivot mechanism is a composite hinge, such as hinge 2342 described with reference to FIGS. 23 and 24, for example. In another embodiment, the pivot mechanism is a living hinge similar to that described above with respect to FIG. 2A. A living hinge may not naturally bias to an open position; therefore, a user may need to assist in pivoting outer counter 1130 to an open position to permit donning and doffing of the shoe.

For donning of the shoe in the open position, a user inserts their foot into a foot opening 1102 and steps down on the heel bed of rear portion 1125*a* of midsole 1125 to force outer counter 1130 to pivot upward in a direction of arrow U, against the bias of pivot mechanism, to a closed position in supporting engagement with inner counter 1115 and surrounding the heel of the user. Outer counter 1130 and inner counter 1115 are locked together in the closed position (not shown) by a locking mechanism 1150. When inner counter 1115 is disengaged from outer counter 1130 by means of actuation of a release member 1155 of locking mechanism 1150, outer counter 1130 is biased down in a direction of arrow D and simultaneously enlarges foot opening 1102 by pulling back rear portion 1116 of the collar via connector 1180. In this embodiment, locking mechanism 1150 operates similar to locking mechanism 950 described above with reference to FIG. 9. As such, inner counter 1115 includes a ratchet 1156 which has recesses for anchoring a tooth of a pawl (not shown) extending from an inside surface of release member 1155.

Release member 1155 is pivoted on an axle pin 1154, which may be spring loaded to bias pawl to engage ratchet 1156 until release member 1155 is actuated. In this embodiment, release member 1155 is the form of a button switch, similar to release member 855 shown in FIG. 8. Alternatively, release member 1155 may be formed as a tab, similar to release member 955 shown in FIG. 9, or any other suitable configuration as should be apparent to one skilled in the art. Actuation of release member 1155 removes the pawl tooth from a recess between teeth of ratchet 1156. Outer counter 1130 is then able to pivot relative to inner counter 1115 in direction of arrow D.

Figure 18A:
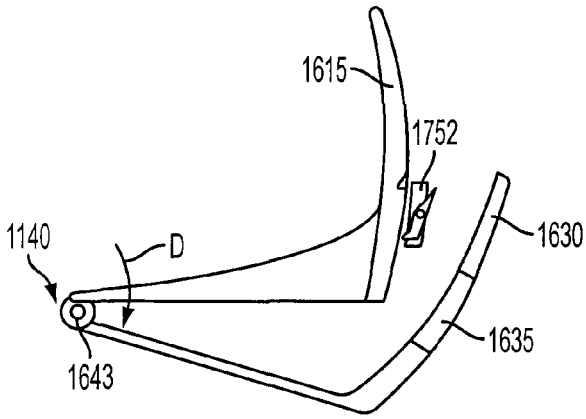
FIG. 18A is a side view of the inner and outer counters of the heel compartment assembly of FIG. 16, illustrating the outer counter in an open and unlocked position.
Figure 18B:
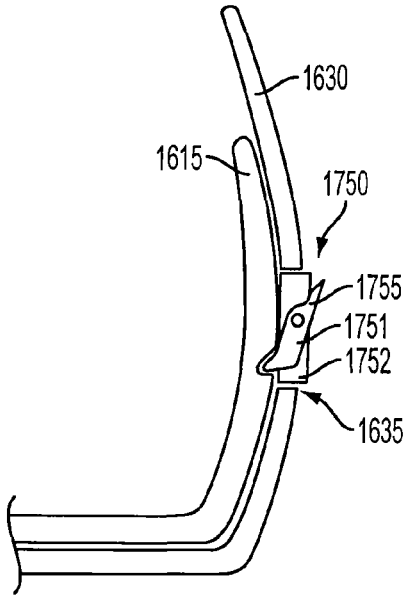
FIG. 18B is a side view of the inner and outer counters shown in FIG. 18A, illustrating the outer counter in a closed and locked position.

In another embodiment, shoe 1100 may be provided with a locking mechanism similar to locking mechanism 1750 described below with reference to FIGS. 18A and 18B.

Figure 12A:
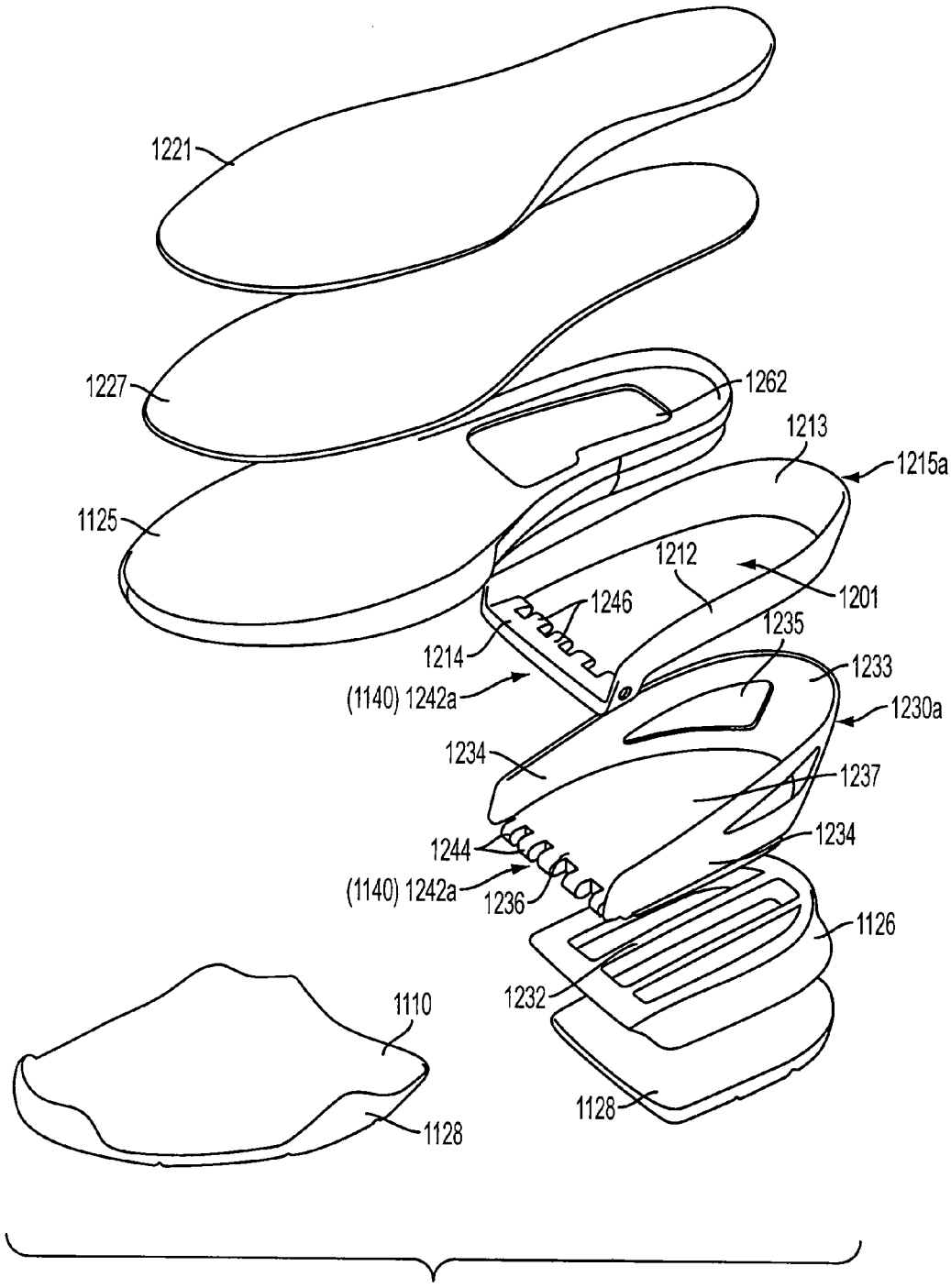
FIG. 12A is an exploded elevation view of a sole structure and heel compartment assembly according to an embodiment of the present invention, viewed from above.
Figure 12B:
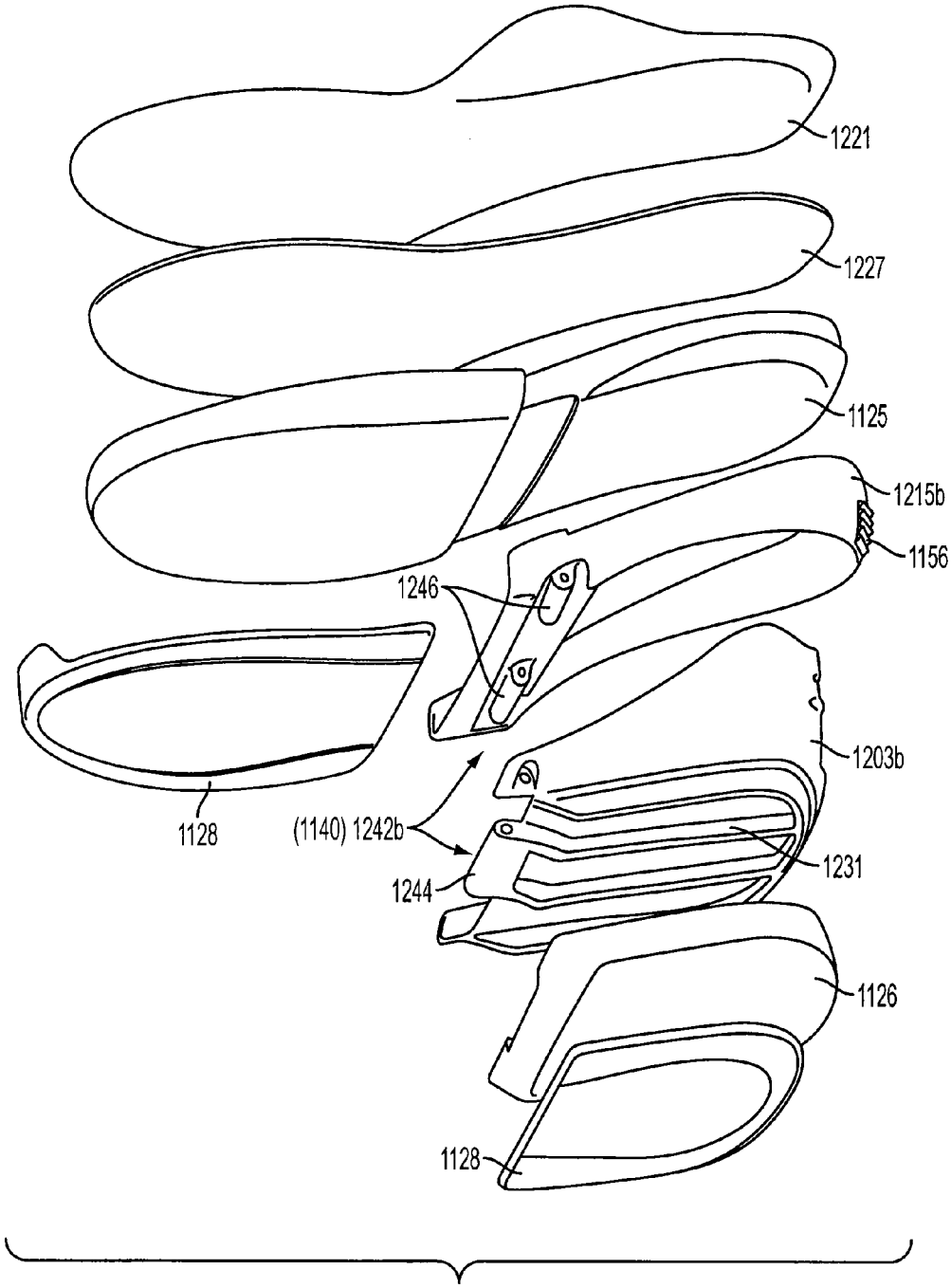
FIG. 12B is an exploded elevation view of a sole structure and a heel compartment assembly according to an embodiment of the present invention, viewed from below.

FIGS. 12A and 12B illustrate exploded views of a sole structure from above and below, respectively. The sole structures of FIGS. 12A and 12B are similar, but for having different embodiments of inner and outer counters. In each sole structure of FIGS. 12A and 12B, an insole 1221 covers a top surface of a strobel sock material or strobel board 1227 to which an upper is stitched, and midsole 1125 is cemented to a bottom surface of strobel board 1227 or joined thereto by other means. Full foot midsole 1125 includes a recess 1262 for receiving a foot pump for an inflatable bladder described above with reference to FIG. 1. In the embodiment of sole structure of FIG. 12A, an inner counter and an outer counter 1230*a* are provided with a pivot mechanism 1242*a* at pivot point 1140. Pivot mechanism 1242*a* is a mechanical hinge that includes multiple tabs 1246 and 1244 on shank members 1214 and 1236 of inner counter 1215*a* and outer counter 1230*a*, respectively, which interlock so as to allow the inner and outer counters to pivot relative to each other. In the embodiment of the sole structure of FIG. 12B, in contrast, a mechanical hinge 1242*b* has fewer interlocking tabs 1246 and 1244 on an inner counter 1215*b* and an outer counter 1230*b*, respectively. Inner counter 1215*a* of FIG. 12A includes an opening 1201 framed by a rear heel portion 1213, lateral and medial side members 1212 and shank member 1214. In contrast, outer counter 1230*a* has a bottom member 1237 framed by a rear heel portion 1233, lateral and medial sided members 1234 and shank member 1236. Outer counter 1230*a* further includes lateral and medial side cut-outs 1235 to expose inner counter 1215*a* there through when the inner and outer counters are in abutting arrangement. Outer counter 1230*b* of FIG. 12B is similarly structured as counter 1230*a*, but does not include cut-outs 1235.

Rear foot midsole 1126 is cemented or otherwise coupled to a bottom surface of either one of counters 1230*a* and 1230*b*. To ensure lateral stability of the outer counter and rear foot midsole assembly, ribs 1231 are provided on a bottom surface of outer counter 1230*a* (or 1230*b*) which extend between recesses in ribs 1232 provided on a top surface of rear foot midsole 1126. In the embodiments of sole structures illustrated in FIGS. 12A and 12B, outsole 1128 is divided into discrete forefoot and rear foot pieces. The forefoot outsole piece is cemented to the bottom surface of a forefoot portion of the full foot midsole 1125, and the rear foot outsole piece is cemented to the bottom surface of rear foot midsole 1126.

Figure 13A:
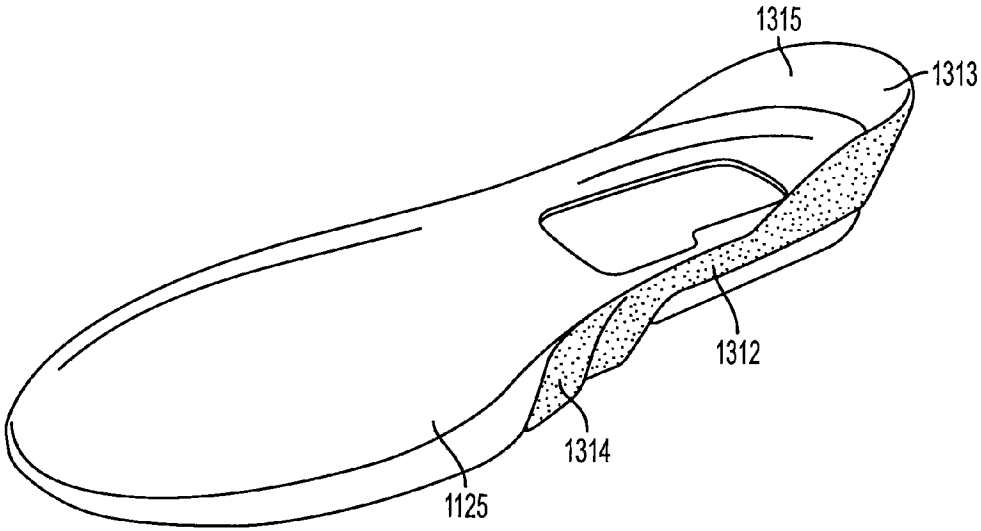
FIG. 13A is an elevation view of a midsole and an inner counter assembly, viewed from above, according to an embodiment of the present invention.
Figure 13B:
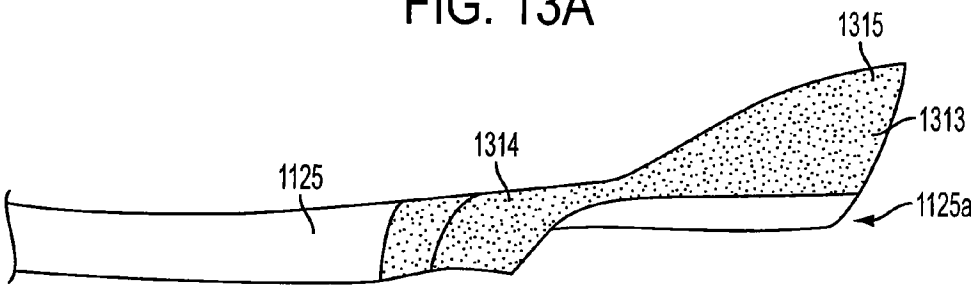
FIG. 13B is a medial side view of the midsole and the inner counter assembly shown in FIG. 13A.
Figure 13C:
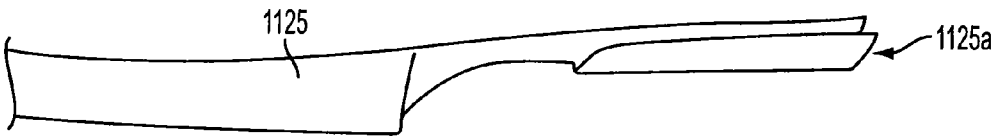
FIG. 13C is a medial side view of the midsole shown in FIGS. 13A and 13B.

FIGS. 13A and 13B illustrate full foot midsole 1125 having attached thereto an embodiment of an inner counter 1315. As shown in FIGS. 13A and 13B, inner counter 1315 is joined to full foot midsole 1125 along a peripheral rim of midsole 1125. Inner counter 1315 includes a vertical rear heel portion 1313 integrally formed with lateral and medial side members 1312 extending longitudinally therefrom to a shank area of midsole 1125, and a shank member 1314, which extends laterally between lateral and medial side members 1312 at the shank area of midsole 1125 (seen in FIG. 12A for shank member 1214). Shank member 1314 provides support for the shank area of the sole and serves as a site for location of mechanical hinge tabs, described above with respect to FIGS. 12A and 12B. A shallow rear portion 1125*a* of midsole 1125 extends visibly below the lower rim of rear heel portion 1313 and lateral and medial side members 1312, and covers an opening in inner counter 1315, so as to form a heel bed. As shown in FIG. 13C, illustrating a side view of midsole 1125 with inner counter 1315 removed, rear portion 1125*a* is shallow in comparison to the forefoot portion of midsole, since rear portion 1125*a* is complemented by rear foot midsole 1126 (not shown) provided on a bottom of an outer counter of a shoe, such as shown in FIG. 11. The combination of rear foot midsole 1126 and shallow rear foot portion 1125*a* of full foot midsole 1125 together provide shock absorbency in the rear foot area of the shoe.

Figure 14A:
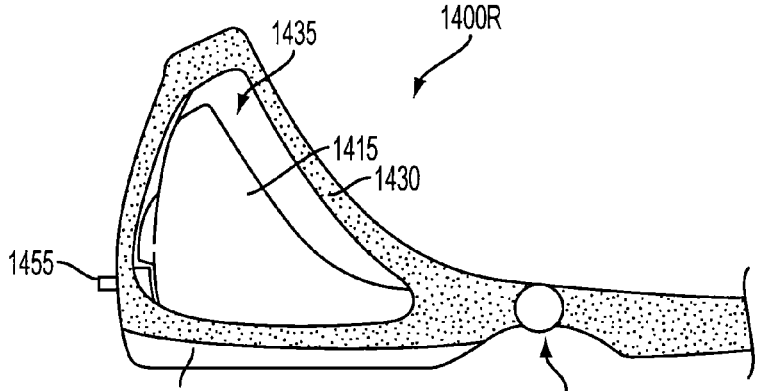
FIG. 14A is a side view of a heel compartment assembly of a shoe according to another embodiment of the present invention.
Figure 14B:
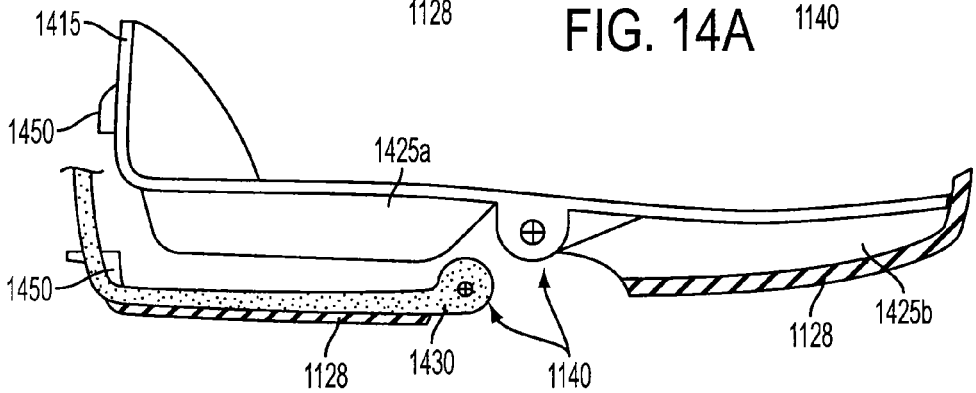
FIG. 14B is a schematic cross-sectional view of a sole structure and the heel compartment assembly of FIG. 14A.
Figure 15A:
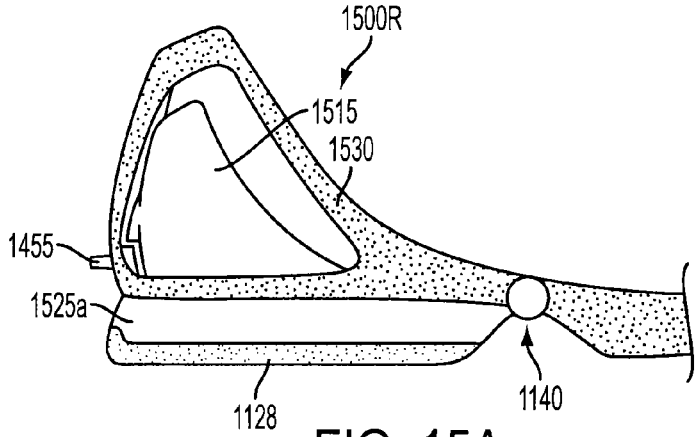
FIG. 15A is a heel compartment assembly of a shoe according to another embodiment of the present invention.
Figure 15B:
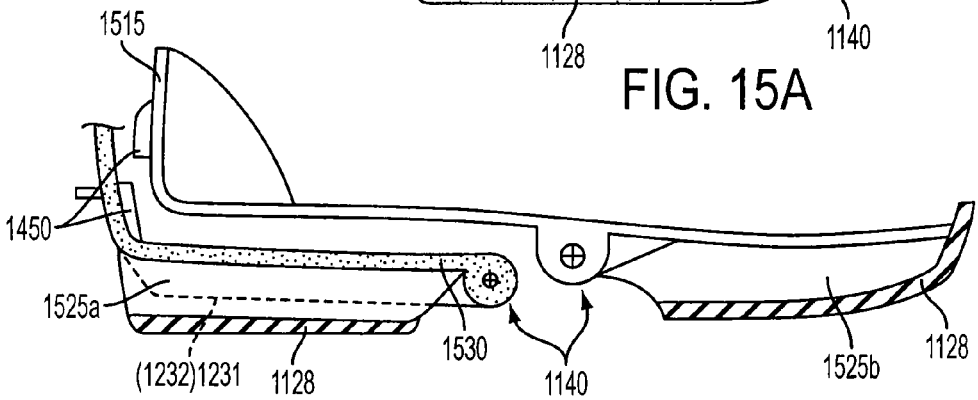
FIG. 15B is a schematic cross-sectional view of a sole structure and the heel compartment assembly of FIG. 15A.

FIGS. 14A and 14B show a heel compartment assembly 1400R according to an embodiment of the present invention. FIGS. 15A and 15B show a heel compartment assembly 1500R according to another embodiment of the present invention. FIG. 14B and FIG. 15B each provide a schematic cross-sectional view of a full sole structure incorporating heel compartment assemblies 1400R and 1500R, respectively. Heel compartment assembly 1400R includes an inner counter 1415 and an outer counter 1430 pivotally connected at pivot point 1140 located at a shank area of the sole. A pivot mechanism, such as an axle hinge, mechanical or otherwise, is disposed at pivot point 1140. Inner counter 1415 and outer counter 1430 are selectively locked together by a locking mechanism 1450 and unlocked by actuation of a release member 1455. Outer counter 1430 may be provided with a cut-out area 1435 that serves to expose at least a portion of inner counter 1415 to the exterior of heel compartment assembly 1400R. Cut-out area 1435 may be any shape or size, and multiple cut out areas may be incorporated in outer counter 1430 for aesthetics. Notwithstanding, it is preferred that outer counter 1430 be configured to provide generally rigid support for a heel of a user's foot. Cut-out areas 1435 may also be provided in any of the other described embodiments, including heel support lever 1730 of FIG. 7A or pivoting heel shell 130 of FIG. 1, for example. Heel compartment assembly 1500R is similarly structured to include an outer counter 1530 with cut-out areas 1535 to expose an inner counter 1515. Likewise, inner counter 1515 and an outer counter 1530 are pivotally connected at pivot point 1140.

With respect to both heel compartment assemblies 1400R and 1500R, the midsole of the shoe sole structure is divided into a rear foot midsole (1425*a* and 1525*a*, respectively) and a forefoot midsole (1425*b* and 1525*b*, respectively). For heel compartment assembly 1400R, rear foot midsole 1425*a* is provided on a bottom of inner counter 1415. For heel compartment assembly 1500R, rear foot midsole 1525*a* is provided on a bottom of outer counter 1530. Outsole 1128 is likewise separated into a forefoot portion and a rear foot portion. For heel compartment assembly 1400R, the forefoot portion of outsole 1128 is provided on the bottom of forefoot midsole 1425*b* and the rear foot portion is provided on a bottom of outer counter 1430. In this embodiment, rear foot midsole 1425*a* is hidden by outer counter 1430 when outer counter 1430 is in supporting engagement with inner counter 1415, and rear foot midsole 1425*a* does not pivot with outer counter 1430. For heel compartment assembly 1500R, the forefoot portion of outsole 1128 is provided on the bottom of forefoot midsole 1525*b* and the rear foot portion of outsole 1128 is provided on a bottom of rear foot midsole 1525*a*. In this embodiment, rear foot midsole 1525*a* is exposed along the exterior surface of heel compartment assembly 1500R, and pivots with outer counter 1530 relative to inner counter 1515.

As shown in FIG. 15B, outer counter 1530 and rear foot midsole 1525*a* include respective ribs 1231 and 1232, drawn with phantom lines. Ribs 1231 and 1232 mesh with each other to improve heel stability when heel compartment assembly 1500R is subjected to lateral forces, as described above with reference to FIGS. 12A and 12B. Though not shown in the embodiment of heel compartment assembly 1400R, similar ribs may be provided on the bottom surface of inner counter 1450 for meshing with ribs provided on the top surface of rear foot midsole 1425*a*.

Locking mechanism 1450 may be any mechanism able to selectively engage inner and outer counters. For example, locking mechanism 1450 may include a single pawl or hook pivotally disposed on outer counter 1430 that selectively engages with an anchoring such as a recess or a rung disposed in or on inner counter 1415. Locking mechanism 950 described above with reference to FIG. 9, or later described locking mechanism 1750 of FIGS. 18A and 18B, may alternatively be employed on heel compartment assemblies 1400R and 1500R. It should be apparent that other types of locking mechanisms may be employed for coupling inner and outer counters without departing from the spirit or scope of the invention.

Figure 16:
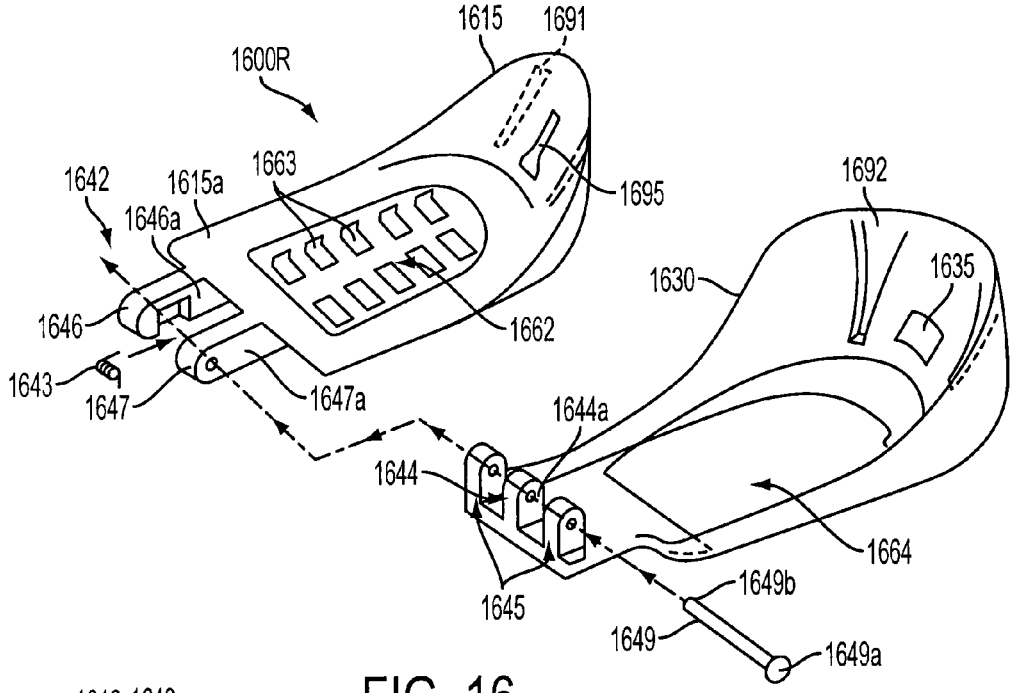
FIG. 16 is an exploded perspective view of an inner counter, an outer counter, and a pivot mechanism of a heel compartment assembly of a shoe according to another embodiment of the present invention.

An exemplary embodiment of a mechanical hinge 1642 provided as a pivot mechanism for an articulated heel portion of a shoe according to the present invention will now be described with reference to FIGS. 16 and 16A to 16D. FIG. 16 is an exploded perspective view of a heel compartment assembly 1600R (with a sole structure omitted), including an inner counter 1615 and an outer counter 1630 incorporating mechanical hinge 1642. Inner counter 1615 and outer counter include a slot 1695 and a window 1635, respectively, for receiving components of a later described locking mechanism 1750 shown in FIGS. 18A and 18B. Slot 1695 and window 1635 may be incorporated into any inner and outer counter of a heel compartment assembly regardless of the type of pivot mechanism being employed. Further, pivot mechanisms and locking mechanisms described herein may be individually selected and incorporated into an articulated heel portion of a shoe in accordance with the present invention. Details regarding an exemplary embodiment of a slot on an inner counter for receiving locking mechanism components is described below with reference to FIGS. 20, 21, and 21A-C.

Inner counter 1615 includes one or more vertically extending ribs 1619 on an outside rear surface of inner counter 1615 that align with a corresponding one or more flared slots 1692 that extend vertically along an inner surface of outer counter 1630. In this embodiment, ribs 1691 are disposed on either side of slot 1695, and corresponding flared slots 1692 are provided on either side of window 1613. When assembled, ribs 1691 are disposed in respective flared slots 1692, which serve as vertical tracks for sliding engagement with ribs 1691. The combination of ribs 1691 and flared slots 1692 ensure inner and outer counter alignment when outer counter 1630 is pivoted relative to inner counter 1615 by mechanical hinge 1642. In this embodiment, inner counter 1615 has a bottom member 1615*a* and thereby forms an inner heel cup. A recess 1662 is formed in a top surface of bottom member 1615*a* for receiving a foot pump for an inflatable bladder, similar to recess 1262 provided in midsole 1125 of FIG. 12A. A bottom surface of bottom member 1615*a* may be convex as a result of recess 1663 in the top surface. A corresponding recess 1664 may be provide in a bottom member of outer counter 1630 for meshing with the convex bottom surface of bottom member 1615*a*, thereby allowing the bottom members of the outer and inner counters to be flush against each other in a closed position (illustrated in FIG. 18B). Later described inner counter 3215 and outer counter 3230 also incorporate respective recesses 1662 and 1664, the bottom views of which are shown in FIGS. 33A and 33B. As shown in FIG. 16, recess 1662 may include one or more cut-outs or windows 1663 to provide reprieve for the foot pump under pressure as well as to reduce construction materials and weight of heel compartment assembly 1600R.

In this embodiment, mechanical hinge 1642 includes three tabs extending from outer counter 1630 that intermesh with two tabs of inner counter 1615 when heel compartment assembly 1600R is assembled. Specifically, inner counter 1615 has a first tab 1646 with a proximal side 1646*a* and a second tab 1647 with a proximal side 1647*a*. Outer counter 1630 has proximal and distal end tabs 1645 and a middle tab 1644 with a proximal side 1644*a*. A hole H, identified in FIGS. 16A to 16D and 22A, is provided in each of the tabs of hinge 1642. Hole H receives a pin 1649 that relatively rotatably couples inner counter 1615 with outer counter 1630 by securing their respective tabs together. Pin 1649 has an elongated body extending between a pin head 1649*a* and a pin tail 1649*b*. Details regarding hole H and pin 1649 are provided below with reference to FIGS. 22A and 22B.

Figure 16A:
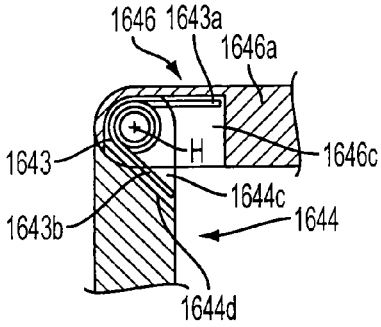
FIG. 16A is a side view of inner and outer counter hinge tabs biased with respect to each other, with a biasing means housed between the tab is made visible.

A torsion spring 1643 is provided between first tab 1646 of inner counter 1615 and middle tab 1644 of outer counter 1630. FIG. 16A is a side view of middle tab 1644 biased with respect to first tab 1646 by torsion spring 1643 housed therebetween. Proximal side 1646*a* of first tab 1646 includes a recess 1646*c* for housing a portion of spring 1646, and middle tab 1644 includes a recess 1644*c* provided on its distal side 1644*b* for housing another portion of spring 1643. Together recesses 1644*c* and 1646*c* form a spring housing for spring 1643. Proximal side 1644*a* of middle tab 1644 has been cut away in FIG. 16A to make visible the spring housing formed by recesses 1644*c* and 1646*c*.

As shown in FIG. 16A, a distal leg 1643*a* of spring 1643 is lodged in recess 1646*c* of first tab 1646 of inner counter 1615, and a proximal spring leg 1643*b* of spring 1643 is lodged in recess 1644*c* of middle tab 1644 of outer counter 1630. Proximal spring leg 1643*b* biases against a ledge 1644*d* that also forms a bottom wall of recess 1644*c*. In this manner, spring 1643 biases outer counter 1630 in the direction of arrow D to an open position relative to inner counter 1615, as illustrated in FIG. 18A. In the open position, in one embodiment, a bottom surface of outer counter 1630 is at an angle of 35 to 45 degrees relative to a bottom surface of inner counter 1615. Depending on the vertical height of outer counter 1630 relative to vertical height of inner counter 1615, the angle of rotation of outer counter 1630 relative to inner counter 1615 in the direction of arrow D may be more or less than 35 to 45 degrees in order to permit opening of the rear of the shoe for rear entry and exit thereof by the user. In a closed position illustrated in FIG. 18B, the bottom surface of outer counter 1630 is parallel to the bottom surface of inner counter 1615. Torsion spring 1643, biasing outer counter 1630 open as shown in FIG. 18A, is loaded in the closed position of FIG. 18B. A locking mechanism such as locking mechanism 1750 or the ratchet and pawl locking mechanism 950 of FIG. 9 (or other locking mechanism apparent to one skilled in the art) is therefore used to lock outer counter 1630 in the closed position, thereby maintain outer counter 1630 in abutting engagement with inner counter 1615.

It should be apparent that other mechanical hinge configurations may be employed to pivotally couple the inner and outer counters together without departing from the spirit or scope of the invention. As should be understood, spring 1643 may alternatively be disposed between second tab 1647 and middle tab 1644. In addition, multiple torsion springs 1643 may be used in hinge 1642 to increase the biasing force in the open position. Further, a greater or lesser number of intermeshing tabs may be used to construct a mechanical hinge for coupling the inner and outer counters. The tabs may extend across all or part of the width of inner and outer counters 1615 and 1630, respectively, at a shank area of the shoe. Also, intermeshing tabs may be disposed at the lateral and medial sides of the counters with a space between the lateral side tabs and the medial side tabs. In one embodiment, not shown, instead of recesses 1644*c* and 1646*c*, spring 1643 may be disposed on a peg projecting from a tab that extends from the outer counter, with one end of the spring fastened to the tab on the outer counter and the other end of the spring bearing against a bottom surface of the inner counter.

In another embodiment, one or more flat springs may be used in place of torsion springs 1643. For example, FIG. 32 illustrates a heel compartment assembly 3200R having an inner counter 3215 and an outer counter 3260 which are pivotally attached together by a mechanical hinge 3242. Mechanical hinge 3242 employs flat springs 3243 as a means to bias outer counter 3260 in an open position, away from inner counter 3215 (as illustrated in FIG. 32). FIGS. 33A and 33B illustrate bottom views of inner counter 3215 and outer counter 3260, respectively, and FIGS. 33C and 33D illustrate perspective side and front views of springs 3243, respectively. In this embodiment, flat springs 3243 are each a rectangular sheet of spring metal having a single bend or flexure 3240 located approximately midway along its length. Springs 3243 are positioned relative to the counters so that with the ends of springs 3243 flex away from the counters. As illustrated in FIG. 32, one end of each spring is secured to outer counter 3230 by a clamp 3269 and the opposite end of each spring 3243 is secured to inner counter 3215 by a clamp 3268. Clamps 3268 and 3269 may be formed as rectangular-shaped stirrups that extend from the bottom surfaces of inner counter 3215 and support each end of spring 3243. Like hinge 1642, described above, hinge 3242 includes tabs 3246 extending from inner counter 3215 that intermesh with tabs 3244 and 3245 extending from outer counter 3230 when heel compartment assembly 3200R is assembled. Specifically, middle tabs 3244 of outer counter 3230 each extend between a pair of tabs 3246 located on the lateral and medial side of inner counter 3215. A portion of recess 1662 of inner counter 3215 extends between each pair of tabs 3246 for holding components of an inflatable assembly, such as valve components of the foot pump. Lateral and medial side tabs 3245 of outer counter 3230 are end tabs of hinge 3242 that receive respective lateral and medial side hinge pins 3349. Hinge pins 3249 (only one shown) relatively rotatably secure tabs together on the respective lateral and medial sides of the counters.

Figure 16B:
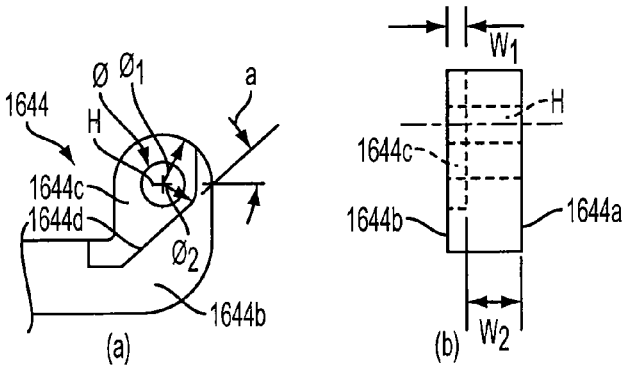
FIG. 16B is a distal side view (a) and cross-sectional view (b) of a middle hinge tab of outer counter of the heel compartment assembly shown in FIG. 16.

Details regarding exemplary dimensions of middle tab 1644 of outer counter 1630 and tab 1646 and 1647 of inner counter 1615 will now be described with reference to FIGS. 16B, C and D, respectively. FIG. 16B shows a side view (a) of distal side 1644*b* and a cross-sectional view (b) of middle hinge tab 1644. Hole H extends through tab 1644, from proximal side 1644*a* to distal side 1644*b* of tab 1644. Hole H through tab 1644 has a diameter Ø between 3.0 mm and 4.5 mm. A semi-circular peripheral surface of tab 1644 has a diameter $Ø_1$ of about 10.0 mm, with half the diameter $Ø_1$ defining a distance from the center of hole H to the semi-circular peripheral surface. One half of a diameter $Ø_2$ of about 7.15 represents a distance from the center of hole H to ledge 1644*d*. Ledge 1644*d* extends at an angle $\alpha$ to the horizontal. In this embodiment, angle $\alpha$ is 35 degrees. As illustrated in cross-sectional view (b), a width $W_1$ of recess 1644*c* is between about 1.65 mm to about 2.15 mm, and a width $W_2$ of middle tab 1644 uninterrupted by recess 1644*c* is about 3.0 mm.

Figure 16C:
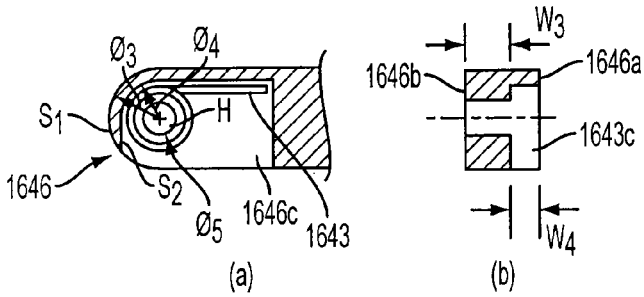
FIG. 16C is a proximal side view (a) and cross-sectional view (b) of a tab of the inner counter of the heel compartment assembly shown in FIG. 16.

FIG. 16C shows a side view (a) of proximal side 1646*a* of first tab 1646 and a cross-sectional view (b) of tab 1646 of inner counter 1615. As noted above, first tab 1646 includes a recess 1646*c* for housing torsion spring 1643, also shown. Torsion spring 1643 may have an inner diameter of about 4.25 mm and an outer diameter of about 7.14 mm. Spring 1643 is concentrically aligned with hole H that extends through tab 1646 from its proximal side 1646*a* to its distal side 1646*b*. In this embodiment, hole H through tab 1646 has a diameter $Ø_5$ between 3.0 mm and 4.5 mm, and the inner diameter of spring 1643 is slightly larger than diameter $Ø_5$ of hole H. Tab 1643 has a peripheral surface S1 and an inside surface S2 each having a curved portion at an end of tab 1643 that is opposite to an end adjoined to inner counter 1615. The center of hole H may be disposed in tab 1646 so that the distance from the center of hole H to the curved portion of inside surface S2 represents a radius of a circle having a diameter $Ø_4$ of about 7.15 mm, and a distance from the center of hole H to the curved portion of peripheral surface S1 represents a radius of a circle having a diameter $Ø_3$ of about 10.0 mm. With spring 1643 having an outer diameter of 7.14 mm, spring 1643 is then disposed just adjacent to inner surface S1 when spring 1643 is concentrically aligned with hole H as shown. As illustrated in cross-sectional view (b) of FIG. 16C, recess 1643*c* of tab 1646 has a width $W_4$ of about 1.65 mm to about 2.15 mm, and a width $W_3$ of tab 1646 uninterrupted by recess 1643*c* is about 3.0 mm.

Figure 16D:
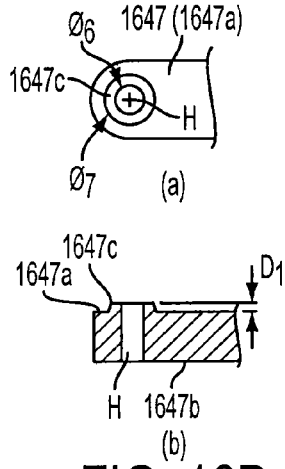
FIG. 16D is a proximal side view (a) and cross-sectional view (b) of another hinge tab of the inner counter of the heel compartment assembly shown in FIG. 16.
Figure 17A:
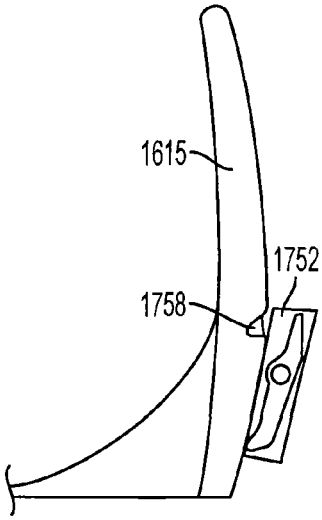
FIG. 17A is a side view of the inner counter of the heel compartment assembly of FIG. 16, illustrating a pawl carrier component of a locking mechanism in an unlocked position.
Figure 17B:
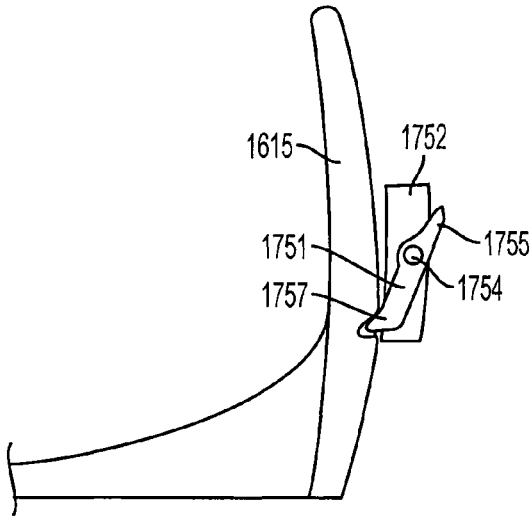
FIG. 17B is a side view of the inner counter shown in FIG. 17A, illustrating a pawl carrier component of a locking mechanism in a locked position.

FIG. 16D shows a side view (a) of proximal side 1647*a* of second tab 1647 and a cross-sectional view (b) of tab 1647 of inner counter 1615. In this embodiment, a diameter $Ø_6$ of hole H through tab 1647 is between 3.0 mm and 4.5 mm, and in one embodiment diameter $Ø_6$ is 3.5 mm. As shown in cross-sectional view (b), hole H extends between proximal side 1647*a* and a distal side 1647*b* of tab 1647. A circular projection 1647*c* having a depth D of about 2.0 mm to about 2.5 mm surrounds hole H on proximal side 1647*a*. Projection 1647*c* has an outer diameter $Ø_7$ of 6.0 mm and an inner diameter same as diameter $Ø_6$ of hole H through second tab 1647. When hinge 1642 is assembled, projection 1647*c* abuts a distal side of proximal end tab 1645 of outer counter 1630. Projection 1647*c* reduces the contact surface area between tabs of inner counter 1615 and outer counter 1630, thereby reducing frictional resistance and facilitating pivoting of outer counter 1630 relative to inner counter 1615.

Figure 22A:
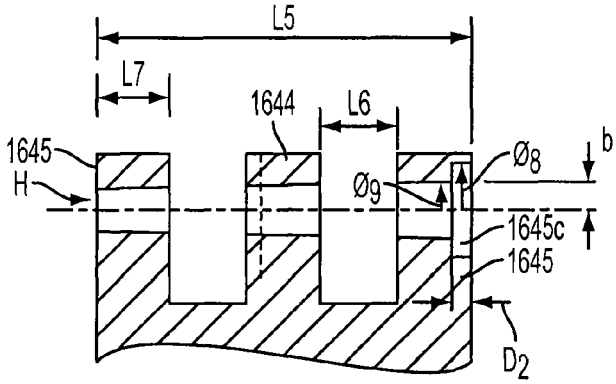
FIG. 22A is a cross-sectional view of tabs extending from the outer counter of the heel compartment assembly of FIG. 16, illustrating a hole for receiving a hinge pin.
Figure 22B:
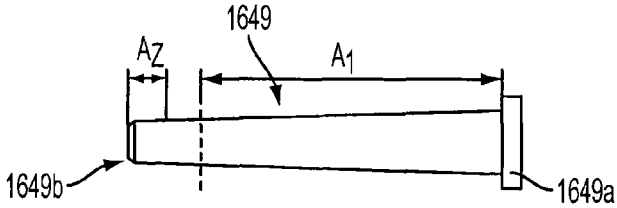
FIG. 22B is a side view of a hinge pin.

Details regarding hole H and pin 1649 will now be described with reference to FIGS. 22A and 22B. FIG. 22A shows a cross-sectional view of proximal and distal end tabs 1645 and middle tab 1644 of outer counter 1630, with hole H extending through these tabs for receiving hinge pin 1649. In this embodiment, a total length $L_5$ between proximal and distal end tabs is about 25 mm. A typical width $L_7$ of each tab is about 5.0 mm. A typical distance of $L_6$ between middle tab 1644 and proximal or distal end tabs 1645 is about 5.1 mm. Proximal end tab 1645 includes recess 1645*c* having a diameter $Ø_8$ of about 7.0 mm for housing pinhead 1649*a*. A diameter $Ø_9$ of hole H ranges from 3.0 mm to 4.5 mm, and tapers between proximal end tab and distal end tabs 1645 by a degree b of 1 to 2 degrees. Recess 1645*c* has a depth $D_2$ of about 2.5 mm. In one embodiment, hole H and pin 1649 are configured so that when pin 1649 is inserted, pin 1649 has a clearance of about 0.10 mm along length $A_1$ of its body. Pintail 1649*b* may include a 1 mm chamfer, and from pin tail 1649*b* along a body length $A_2$ of 3 mm, pin 1649 may be press-fit in hole H (i.e., pin 1649 has zero clearance when inserted).

A locking mechanism 1750 will now be described with reference to FIGS. 17A, 17B, 18A to 18C and 19A to 19C. Locking mechanism 1750 includes a pawl 1751 rotatable about an axis 1754 and having a release member 1755 (such as a press tab) at one end and a pawl tooth 1757 at an opposite end. Pawl 1751 pivots along axis 1754 from a lowered position L to a raised position R illustrated in FIG. 19C. A spring or other biasing means may be provided on pawl 1751, at axis 1754, for example, to bias pawl 1751 in lowered position L. Actuation of release member 1755 rotates pawl 1751 against the spring bias to raised position R. Pawl 1751 is supported by a pawl carrier component 1752 movably disposed on a rear exterior surface of inner counter 1615 so as to slide vertically along slot 1695 or later described slot 2095 shown in FIG. 20. Though not necessary, a biasing means (not shown) may be included to bias carrier 1752 in a down position illustrated in FIG. 17A, such as by a tension coil spring having one end coupled to carrier 1752 and another end coupled near a rear bottom end of inner counter 1615. The down position of carrier 1752 corresponds with the open position of outer counter 1630, as shown in FIG. 18A. FIGS. 18A and 18B provide side views of inner counter 1615 and outer counter 1630 in the open position and closed position, respectively.

Figure 18C:
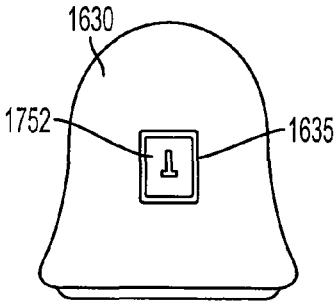
FIG. 18C is a rear view of the inner and outer counters of FIG. 18B.
Figure 19A:
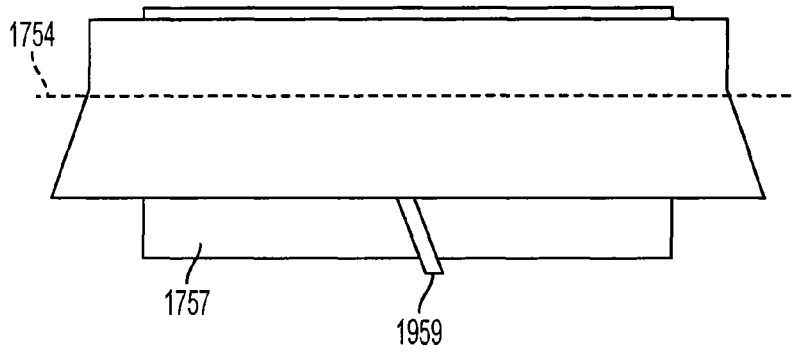
FIG. 19A is an above-plan view of the pawl carrier component of a locking mechanism according to an embodiment of the present invention.
Figure 19B:
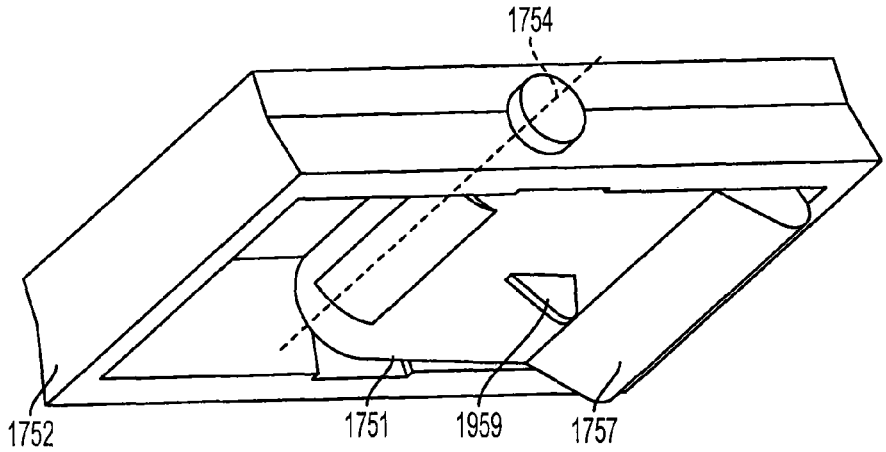
FIG. 19B is a perspective view of the pawl carrier component of FIG. 19A, viewed from below.
Figure 19C:
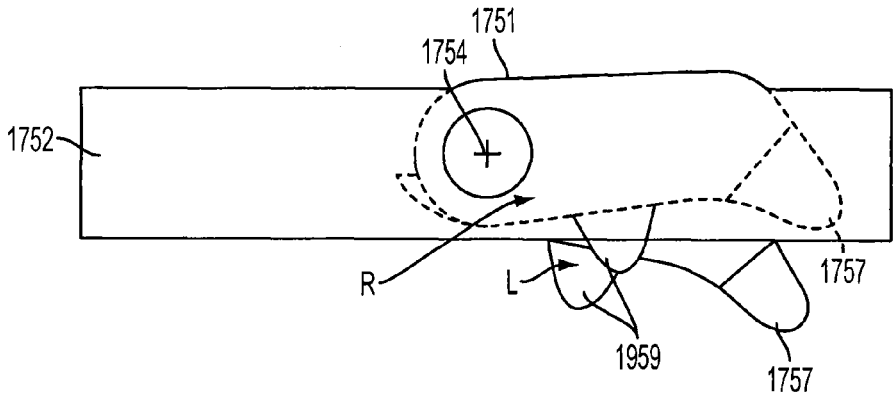
FIG. 19C is a side view of the pawl carrier component of FIGS. 19A and 19B, illustrating a pawl in a raised and a lowered position.

As described above, outer counter 1630 is biased in the open position by a biasing means at pivot point 1140 (e.g., torsion spring 1643 of mechanical hinge 1642). When outer counter 1630 advances to the closed position against the bias of spring 1643 (i.e., spring 1643 of hinge 1642 is twisted when a user's heel forces inner counter 1615 to abut outer counter 1630), a lower surface of a window 1635 in outer counter 1530 engages carrier 1752 and forces carrier 1752 upward (against the bias of the tension spring coupled to carrier 1752, if provided). In the closed position shown in FIG. 18B, outer counter 1630 is in supporting engagement with inner counter 1615, carrier 1752 extends through window 1635, spring 1643 is loaded, and the tension spring of carrier 1752, if provided, is also loaded. FIG. 18C illustrates a rear view of outer counter 1630 with pawl carrier 1752 extending through window 1635 of outer counter 1630.

To lock the outer counter 1615 in this closed position, pawl tooth 1757 of pawl 1751 engages with a recess 1758 provided in the exterior surface of inner counter 1615. Since pawl 1751 is biased in the lowered position L, tooth 1757 is forced into recess 1758 when they become aligned. In this manner, downward movement of outer counter 1630 under bias of torsion spring 1643, and downward movement of carrier under bias of the tension spring, if provided, are prevented. To return to the open position of FIG. 18A, release member 1755 is actuated so as to pivot tooth 1757 out of recess 1758. Spring 1643 is then free to unload and pivots outer counter 1630 in direction D. To hold tooth 1757 in raised position R and clear of recess 1758 during the return to the open position of FIG. 18A, pawl 1751 may further include a kickstand 1959 for engaging with a later described ledge 2099 (shown in FIG. 21A).

Figure 20:
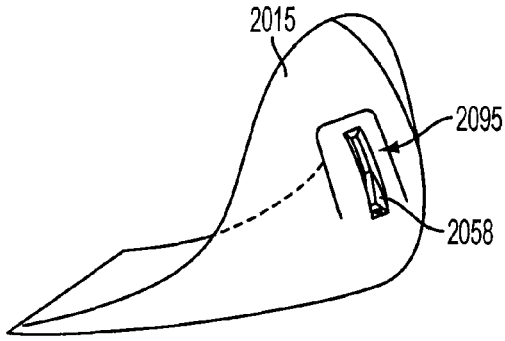
FIG. 20 is a perspective view of an inner counter according to an embodiment of the present invention, viewed from a rear end.
Figure 21:
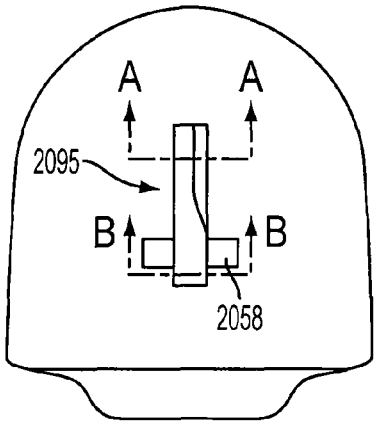
FIG. 21 is a rear view of the inner counter of FIG. 20, illustrating a slot for receiving components of a pawl of a locking mechanism.
Figure 21A:
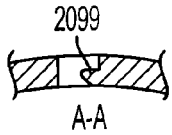
FIG. 21A is a cross-sectional view taken along line A-A of FIG. 21.
Figure 21B:
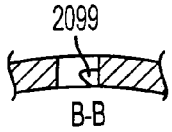
FIG. 21B is a cross-sectional view taken along line B-B of FIG. 21.
Figure 21C:
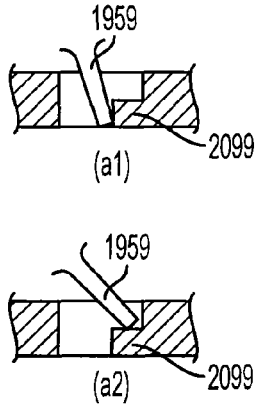
FIG. 21C is a schematic of a component of a pawl at different positions of the slot as viewed in the cross-section of FIG. 21A.

Details regarding an exemplary slot 2095 for receiving kickstand 1959 and pawl tooth 1757 will now be described with reference to FIGS. 20, 21 and 21A to 21C. FIG. 20 illustrates a perspective view of an inner counter 2015 having slot 2095 provided on its vertical rear portion of inner counter 2015. A rear view of inner counter 2015 with slot 2095 is illustrated in FIG. 21. FIGS. 21A and 21B illustrate cross-sectional views taken along the lines A-A and B-B of FIG. 21, respectively. A recess 2058 for receiving pawl tooth 1757 extends laterally from both sides of a lower end of slot 2095. Ledge 2099 extends laterally into slot 2095 for engaging with kickstand 1959 of pawl 1751. As shown in FIG. 21B, ledge 2099 does not extend the vertical length of slot 2095, but rather is positioned above recess 2058. FIG. 21C is a cross-section of slot 2095 illustrated in FIG. 21A, showing a schematic of kickstand 1959 disposed at position (a1) corresponding to its lowered position L (a1) and position (a2) corresponding to its raised position R of FIG. 19C. When tooth 1757 is pivoted out engagement with recess 2058 (such as by actuation of release member 1755, described above), kickstand 1959 moves to position (a2) to rest on ledge 2099, thereby holding tooth 1757 in the raised position R and clear of recess 2058.

Figure 23:
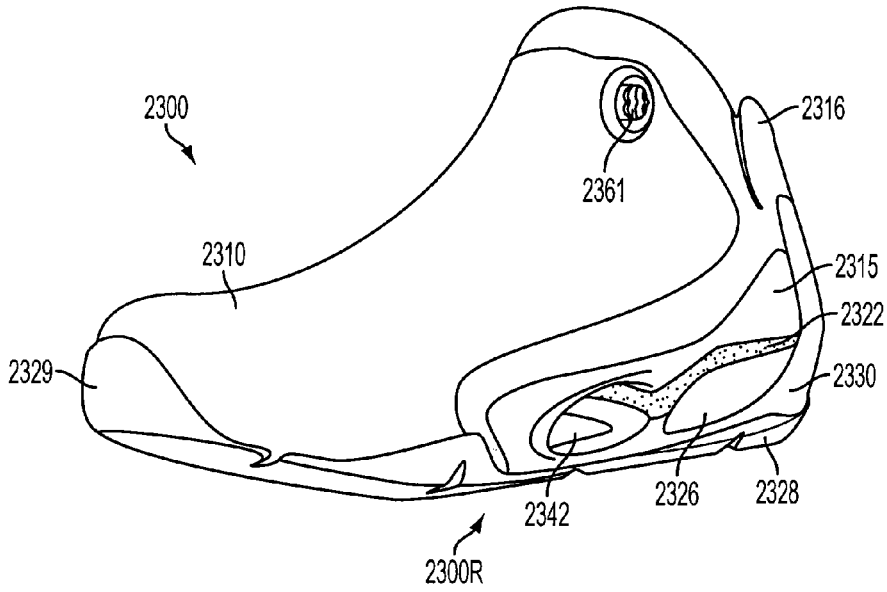
FIG. 23 is a perspective view of a lateral side of a shoe according to another embodiment of the present invention.
Figure 24:
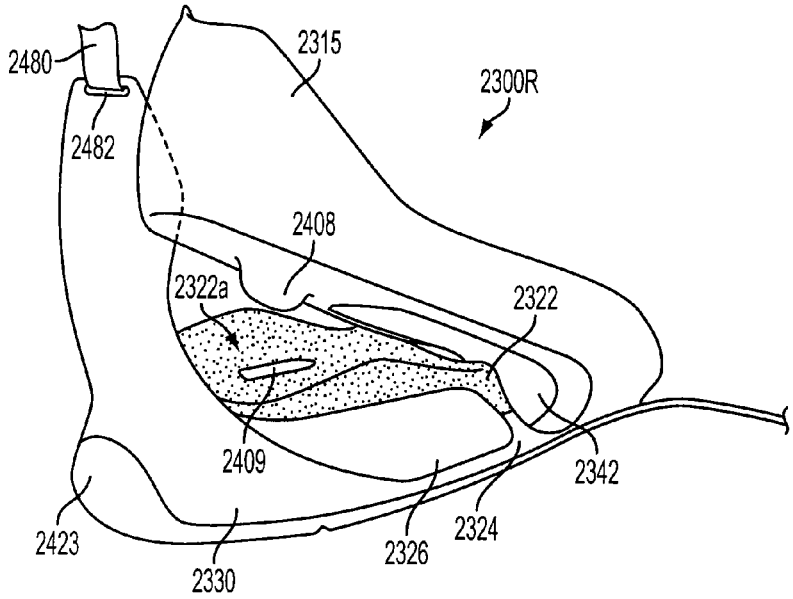
FIG. 24 is a perspective view of a heel compartment assembly of the shoe of FIG. 23.

In another embodiment of a pivot mechanism for a shoe according to the present invention, a composite hinge replaces the mechanical hinge discussed above for providing a shoe with an articulated heel portion to permit rear entry and exit of a user's foot. As shall be further described below, use of a composite hinge permits the articulated heel portion for the shoe to be simply constructed without multiple discrete parts as is required by the mechanical hinge described above with reference to FIG. 16. FIG. 23 shows a shoe 2300 having a heel compartment assembly 2300R with a composite hinge 2342 in accordance with one embodiment of the present invention. Composite hinge 2342 is disposed at a shank area, between a forefoot and a rear foot area, of shoe 2300. Similar to the earlier described mechanical hinge embodiments, composite hinge 2342 permits an outer counter 2330 to pivot relative to an inner counter 2315 between a closed position illustrated in FIG. 23 to an open position illustrated in FIG. 24. The inner and outer counters are maintained in the closed position by a locking mechanism (not shown), such as locking mechanism 1750 described above. As shown in FIG. 23, heel compartment assembly 2300R is stock fitted to an upper 2310. In one embodiment of construction, a bladder (not shown) is stitched to upper 2310 and is provided with a check valve 2361. Inner counter 2315 is cemented to a bottom of lasted upper 2310, leaving outer counter 2330 free to rotate down via composite hinge 2342. In this embodiment, shoe 2300 further includes a toecap 2329 and a heel cap 2423. A forefoot midsole, not shown, extends between composite hinge 2342 and toecap 2329. Alternatively, a full foot midsole may extend the length of shoe 2300, from inner counter 2315 to toe cap 2329, in a similar configuration as described above with reference to FIG. 13A. An outsole 2328 extends between toecap 2329 and heel cap 2423 along the bottom of shoe 2300, and may be divided at the shank area into forefoot and rear foot portions. As shown in FIG. 24, a ring opening 2482 is provided on an upper rear end of outer counter 2330. A connector 2480 is looped through ring opening 2482 and has an end (not shown) that is joined to a heel collar portion 2316 of upper 2310 (seen in FIG. 23) with outer counter 2330, in a similar manner as connector 1180 shown and described with reference to FIG. 11.

In heel compartment assembly 2300R, inner counter 2315 and outer counter 2330 are molded as a one-piece structure. Inner counter 2315 and outer counter 2330 may be made of a hard durometer plastic such as thermoplastic urethane (TPU). In the closed position, a rear foot midsole 2326 is sandwiched between inner counter 2315 and outer counter 2330. Midsole 2326 (and the midsoles of the shoes described in the above embodiments, as well) may be formed of any shock absorbent material, such as fluid filled inserts or foam material (for example, ethyl vinyl acetate (EVA)) or polyurethane (PU). An over-mold component 2322 covers a top surface of midsole 2326 and extends to a bracket 2324 that is integrally molded with inner and outer counters 2315 and 2330. In this construction, midsole 2326 is exposed on the lateral and medial sides of heel compartment assembly 2300R and framed along its remaining sides by outer counter 2330, bracket 2324, and over-mold component 2322. A top surface 2322*a* of over-mold component 2322 is provided with a recess 2409 for receiving and meshing with a stabilizer 2408 extending from a bottom surface of inner counter 2315. Stabilizer 2408 extends in recess 2409 when heel compartment assembly is in the closed position (as shown in FIG. 23) to prevent lateral movement of inner counter 2315 relative to outer counter 2330 and stabilize the heel area of shoe 2300. In one embodiment, multiple stabilizers are provided on the bottom surface of the inner counter. For example, an inner counter 2815, illustrated in FIG. 28, includes two stabilizers 2808 extending along the lateral and medial sides of a bottom surface of counter 2815. To receive stabilizers 2808, corresponding recesses are provided in an over-mold component, such as, for example, recesses 3109 provided in later described over-mold component 3122, illustrated in FIG. 31B. In another embodiment, not shown, a heel compartment assembly for a shoe according to the present invention includes three stabilizers on a bottom surface of an inner counter and three corresponding recesses are provided in a top surface of an over-mold component. It should be understood, however, any number of stabilizers and corresponding recesses may be provided in a shoe heel compartment assembly, as needed.

Similar to shoe 1100, shoe 2300, as well as any of the several embodiments of a heel compartment assembly described herein, includes an inner counter whose vertical height is shallow in comparison to the vertical height of an outer counter. The main function of the height of the inner counter is to be low enough to allow for easy entry of the foot when the heel compartment assembly is in the open position, and the main function of the height of the outer counter is provide a secure fit over the heel when the assembly is in the closed position. Thus, when heel compartment assembly 2300R is pivoted into an open position and heel collar portion 2316 is pulled back by connector 2480, the upper and forefoot areas, along with the inner counter resemble a clog having a shallow heel cup for easy entry and exit of the shoe from the rear. Articulation of the outer counter to a closed position provides heel support and secures the user's foot in the shoe. The heights of both the inner and outer counters may change proportionally with each shoe size. For example, in one embodiment, for a men's size 9, the height of the inner counter (measured from its inside, top surface (e.g., top surface 1615*a* of inner counter 1615)) is approximately 46 mm, and the height of the outer counter (measured from the same spot on the inner counter) is approximately 66 mm.

Figure 25:
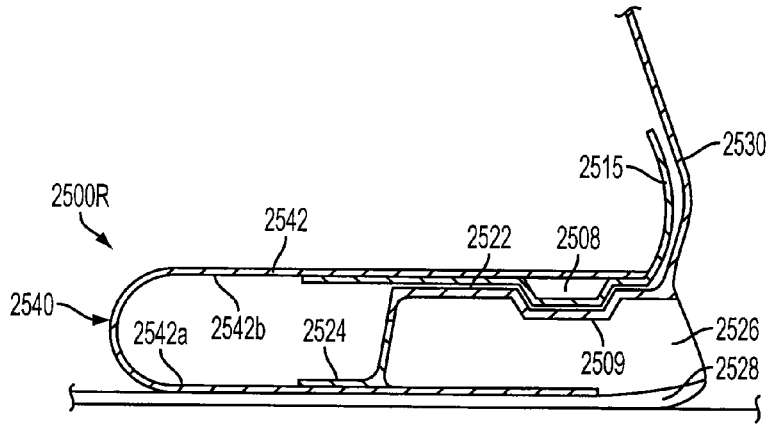
FIG. 25 is a cross-sectional view of a heel compartment assembly according to another embodiment of the present invention.

FIG. 25 shows a cross-sectional view of a heel compartment assembly 2500R according to another embodiment of the present invention. As distinguished from heel compartment assembly 2300R, heel compartment assembly 2500R has a midsole 2526 exposed at a rear periphery of the assembly. A perspective view of a similar construction of an exposed rear foot midsole 3126 is shown and later described with reference to FIG. 31C. In this embodiment, an outer counter 2530 is a separate structure from an inner counter 2515. A composite hinge 2542 has a bottom tongue 2542*a* and a top tongue that extend from a flexure 2540. Inner counter 2515 is adhered to top tongue 2542*b* of composite hinge 2542, and outer counter 2530 is adhered to bottom tongue 2542*a* (via an over-mold component 2522 and midsole 2526). Specifically, a bracket 2524 formed in the shape of an "L" has a vertical leg adhered to a front end wall of midsole 2526, and a horizontal leg adhered to bottom tongue 2542*a* of composite hinge 2542. Over-mold component 2522 extends between the vertical leg of bracket 2542 to a rear end of outer counter 2530 along a top surface of midsole 2526, in a similar manner as over-mold component 2322 shown in FIG. 24. Outer counter 2530 extends vertically from a rear end of over-mold component 2522 and may be integrally molded as a one-piece structure, similar to an outer counter 3130 and over-mold component 3122 illustrated in FIG. 31C. Over-mold component 2522 further includes a recess 2509 for receiving a stabilizer 2508 extending from a bottom of inner counter 2515. Forward of midsole 2526, bottom tongue 2542*a* of composite hinge 2542 is sandwiched between the horizontal leg of bracket 2524 and an outsole 2528, which extends along a bottom of heel compartment assembly 2500R. Rearward of bracket 2524, bottom tongue 2542*a* is sandwiched between midsole 2526 and outsole 2528. Composite hinge 2542 flexes at flexure 2540, thereby permitting outer counter 2530 to pivot relative to inner counter 2515.

In one embodiment, inner and outer counters may be made of a hard durometer plastic, whereas over-mold component 2509 may be made of a soft durometer plastic such as a soft durometer PPU. Bracket 2524 may likewise be formed of a hard durometer plastic. Like materials of construction may be employed in the embodiment of FIGS. 23 and 24. As such, in heel compartment assembly 2300R, bracket 2324, inner counter 2315, and outer counter 2330 are easily formed as a one-piece structure.

Figure 26A:
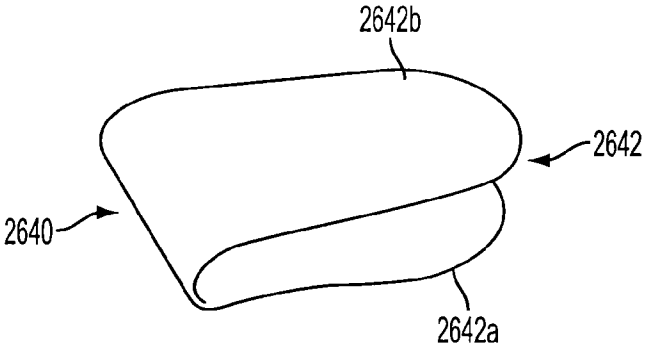
FIG. 26A is a perspective view of a composite hinge in a closed position.
Figure 26B:
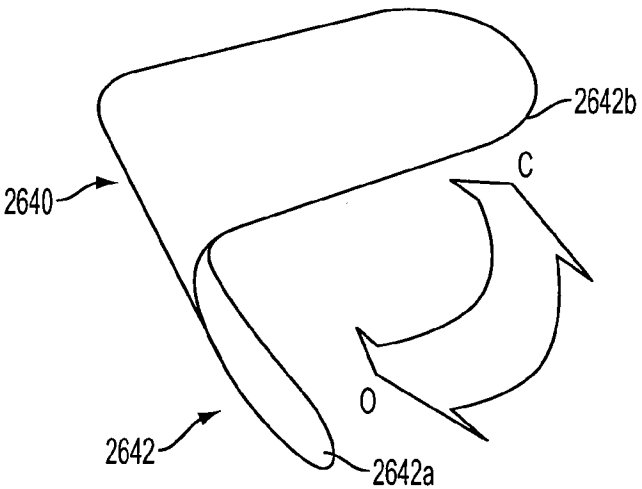
FIG. 26B is a perspective view of the composite hinge of FIG. 26A, shown in an open position.

Description of a composite hinge 2642 for incorporation in heel compartment assemblies 2300R and 2500R, as well as later described 3100R, will now be presented with reference to FIGS. 26A and 26B. Composite hinge 2642 is a single structure having a top tongue 2642*b* that may be approximately co-extensive with a bottom tongue 2642*a*. Top tongue 2642*b* and bottom tongue 2642*a* are joined at a flexure 2640 and form an integral one-piece structure. Composite hinge 2642 flexes at flexure 2640 so as to pivot between a closed position shown in FIG. 26A and an open position shown in FIG. 26B. In this embodiment, bottom tongue 2642*a* opens downward relative to top tongue 2642*b* in a direction shown by arrow O and closes upward in a direction shown by arrow C. Alternatively, composite hinge 2642 may be configured such that top tongue 2642*b* pivots upward to an open position with bottom tongue 2642*a* remaining anchored on a horizontal plane. In either instance, in the closed position, top tongue 2642*b* and bottom tongue 2642*a* extend approximately parallel to each other, and in the open position, top tongue 2642*b* and bottom tongue 2642*a* are biased away from each other and extend in different directions. In one embodiment, in the open position, bottom tongue 2642*a* is extends at a non-zero angle of less than 90 degrees relative to top tongue 2642*b*, an in one embodiment extends between about 35 to 45 degrees relative to top tongue 2642*b*. Composite hinge 2642 may be constructed so as to be biased in the open position. To achieve this construction, composite hinge 2642 may be molded or otherwise constructed in the open position, and may be made of any material with great memory and ability to withstand pressure when maintained in the closed position when a shoe incorporating composite hinge 2642 is secured on the user's foot. For example, composite hinge 2624 may be a plastic or a spring metal, whose memory permits it to return to the open position after being maintained in the closed position.

Figure 27:
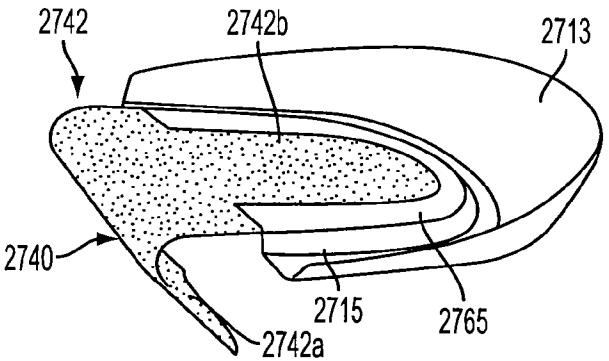
FIG. 27 is a perspective view of an inner counter assembled to a composite hinge according to an embodiment of the present invention.

FIG. 27 shows an embodiment of an inner counter 2715 and a composite hinge 2742 joined together along a peripheral edge of a top tongue 2742*b* of hinge 2742. An over-molded U-shaped rim 2765 of inner counter 2715 is formed along the periphery of top tongue 2742*b*. A vertical rear portion 2713 of inner counter 2715 curves upward from this U-shaped rim 2765, and the combination of the top tongue 2742*b*, U-shaped rim 2765 and vertical rear portion 2713 form a shallow heel cup for receiving the user's heel. A bottom tongue 2742*a* (not fully shown) is integrally joined to top tongue 2742*b* at a flexure 2740. With an outer counter (not shown) being coupled to bottom tongue 2742*a*, composite hinge permits the outer counter to pivot relative to the inner counter 2715.

Figure 28:
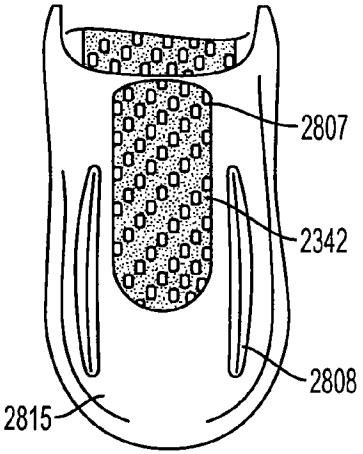
FIG. 28 is a bottom plan view of an inner counter assembled to a composite hinge, according to another embodiment of the present invention.
Figure 29:
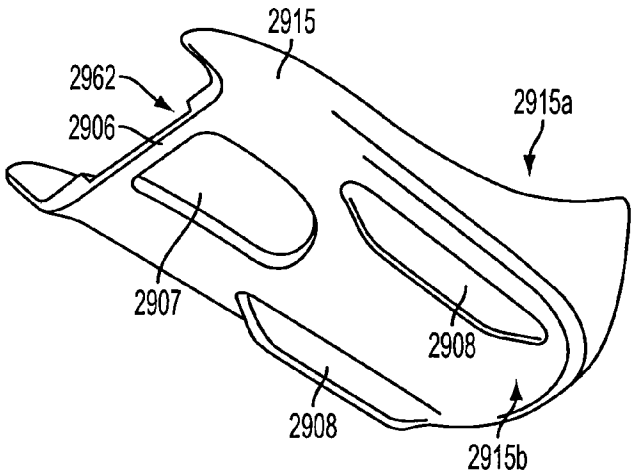
FIG. 29 is a perspective view of another inner counter according to another embodiment of the present invention.

FIG. 28 illustrates another embodiment of an inner counter 2815 that includes a window or cut out portion 2807 disposed between two lateral and medial extending stabilizers 2808. A composite hinge 2342 joins to a top surface of inner counter 2815 and is thereby exposed through window 2807 when viewed from a bottom side shown in FIG. 28. Window 2807 reduces and lightens the heel portion of the shoe by the reduced amount of materials to form inner counter 2815, and also allows a user of a shoe incorporating inner counter 2815 to appreciate any aesthetic design provided on the top tongue of composite hinge 2342 when the shoe is an open position, such as the position shown in FIG. 24. FIG. 29 shows another embodiment of an inner counter 2915 also including a window at 2907, but in this instance window 2907 does not extend toward rear of inner counter 2915 to the extent as that provided on inner counter 2815. Rather, stabilizers 2908 extend along lateral and medial sides of a bottom surface 2915*b* to a rear end of window 2907, which ends approximately even with a position at which stabilizers 2908 begin. In this embodiment, top surface 2915*a* of inner counter 2915 includes a recess 2962 for receiving a tongue of composite hinge 2342 (not shown in FIG. 29) so that the composite hinge and inner counter assembly may form a flush top surface, similar to the top surface of inner counter 2715 illustrated in FIG. 27. Further, inner counter 2915 has a cross bar 2906 that stabilizes lateral medial sides of inner counter 2915 despite window 2907 in inner counter 2915.

FIG. 30A shows a side view of inner counter 2915 as it may be disposed in a heel compartment assembly of a shoe, which is drawn with phantom lines in the figure. FIG. 30B illustrates a cross-sectional view taken along line 30B-30B of FIG. 30A and shows a recess 3062 which may receive a portion of a composite hinge tongue, as well as provide a recess for containing a foot pump (not shown) for an inflatable bladder incorporated into the shoe.

A heel compartment assembly 3100R in accordance with another embodiment of the present invention will be described with reference to FIGS. 31A-C. FIG. 31A provides a prospective side view of a pivoting portion of heel compartment assembly 3100R to include an outer counter 3130 joined to an over-mold component 3122 that covers a top surface of a midsole 3126. A bracket 3124, similar to bracket 2524 described above with reference to FIG. 25, frames a vertical front surface of midsole 3126. In this embodiment, similar to FIG. 25, midsole 3126 is exposed along a rear periphery of the assembly. FIG. 31B provides a perspective top view of recesses 3109 formed in a top surface 3122*a* of the over-mold component 3122. Though not illustrated, recesses 3109 receive stabilizers that extend from a bottom surface of an inner counter 3115. Stabilizers such as those incorporated on a bottom surface of either one of inner counters 2808 or 2908 shown in FIGS. 28 and 29, respectively, may be provided on a bottom surface of inner counter 3115. The stabilizers prevent lateral movement of inner counter 3115 relative to outer counter 3130 when inner counter 3115 is in abutting arrangement with the outer counter 3130 and over-mold component 3122, as illustrated in FIG. 31C.

In one embodiment, similar to the embodiment discussed above with respect to heel compartment assembly 2500R, inner counter 3115, outer counter 3130 and bracket 3124 are each formed of a hard durometer plastic such as hard durometer TPU, whereas over-mold components 3132 may be formed of a soft durometer plastic. Notwithstanding, as shown in FIG. 31C, heel component assembly 3100R may be integrally molded as a one-piece structure to include outer counter 3130, inner counter 3115, bracket 3124, and over-mold component 3122. Rear foot midsole 3126 may then be cemented to a bottom surface of over-mold component 3115 and to a vertically extending leg of bracket 3124.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. An article of footwear, comprising:

a sole having a shank area located between a forefoot portion and a rear foot portion of the sole;

an upper attached to the sole, including:

an inner counter for surrounding at least a part of the heel of a foot; and an outer counter for surrounding at least a part of the heel of the foot; and a pivot mechanism connecting the outer counter to the inner counter so as to permit the outer counter to pivot relative to the inner counter at a pivot point located at the shank area of the sole, the outer counter pivoting between an open position away from the inner counter and a closed position in supporting engagement with the inner counter.

2. The article of footwear of claim 1, wherein the inner counter includes a vertically extending rear heel portion, lateral and medial side members and a shank member, wherein the lateral and medial side members extend longitudinally from the rear heel portion to the shank area of the sole along lateral and medial sides of the footwear, and wherein the shank member extends laterally between the lateral and medial side members at the shank area of the sole.

3. The article of footwear of claim 2, wherein the outer counter includes a second vertically extending rear heel portion, second lateral and medial side members and a second shank member, wherein the second lateral and medial side members extend longitudinally from the second rear heel portion to the shank area of the sole along lateral and medial sides of the footwear, and wherein the second shank member extends laterally between the second lateral and medial side members at the shank area of the sole, wherein the shank member of the inner counter and the second shank member of the outer counter are pivotally attached together by the pivot mechanism.

4. The article of footwear of claim 3, wherein the pivot mechanism is a mechanical hinge.

5. The article of footwear of claim 4, wherein the mechanical hinge includes a torsion spring.

6. The article of footwear of claim 4, wherein the mechanical hinge includes a flat spring.

7. The article of footwear of claim 3, wherein the sole includes a full foot midsole and a rear foot midsole, wherein the rear heel portion, the lateral and medial side members and the shank member of the inner counter define an opening, wherein a rear portion of the full foot midsole covers the opening so as to form a heel bed, the rear heel portion of the inner counter vertically extending from a periphery of the heel bed, wherein the outer counter forms an outer heel cup having a bottom member extending between the second rear heel portion, second lateral and medial side members and the second shank member, wherein the rear foot midsole is attached to a bottom surface of the bottom member, and wherein a top surface of the bottom member abuts a bottom surface of the rear portion of the full foot midsole when the outer counter is in the closed position.

8. The article of footwear of claim 3, wherein the sole includes a forefoot midsole and a rear foot midsole, wherein the inner counter forms an inner heel cup having a bottom member extending between the rear heel portion, lateral and medial side members and the shank member, wherein the outer counter forms an outer heel cup having a bottom member extending between the second rear heel portion, second lateral and medial side members and the second shank member, wherein the rear foot midsole is attached to a bottom surface of the bottom member, and wherein a top surface of the bottom member of the outer counter abuts a bottom surface of the bottom member of the inner counter when the outer counter is in the closed position.

9. The article of footwear of claim 1, wherein the sole further includes a full foot midsole, wherein a bottom anchor portion adheres the outer counter to a bottom side of the midsole forward of the shank area of the sole, wherein the outer counter forms an outer heel cup including a bottom member extending between the rear heel portion and the bottom anchor portion, wherein the pivot mechanism is a living hinge located at the shank area of the sole, the living hinge joining the bottom anchor portion to the bottom member of the outer counter so as to permit the outer counter to pivot between the open and closed positions.

10. The article of footwear of claim 9, wherein the living hinge, the bottom anchor portion, and the outer counter are integrally formed as a one-piece structure.

11. The article of footwear of claim 9, wherein a top surface of the bottom member of the outer counter abuts a bottom surface of a rear foot portion of the full foot midsole when the outer counter is in the closed position.

12. The article of footwear of claim 9, wherein the inner counter is formed of a soft, flexible material.

13. The article of footwear of claim 12, wherein the outer counter is formed of a hard plastic material.

14. The article of footwear of claim 1, wherein the pivot mechanism is a mechanical hinge.

15. The article of footwear of claim 1, wherein the pivot mechanism is a composite hinge.

16. The article of footwear of claim 15, wherein the composite hinge has a flexure, a top tongue and a bottom tongue, the top tongue and the bottom tongue being integrally joined at the flexure, wherein the top tongue and the bottom tongue extend rearward from the flexure, wherein the composite hinge flexes at the flexure between a first position corresponding to when the outer counter is in the open position and a second position corresponding to when the outer counter is in the closed position, wherein the inner counter is connected to the top tongue and the outer counter is connected to the bottom tongue so that the outer counter pivots relative to the inner counter when the composite hinge is flexed at the flexure between the first and second positions, the top tongue and the bottom tongue extend roughly parallel to each other when the composite hinge is in the second position, the top tongue extending above the bottom tongue, and wherein the bottom tongue extends at a non-zero angle relative to the top tongue when the composite hinge is in the first position.

17. The article of footwear of claim 1, further comprising a locking mechanism for selectively securing the outer counter in the closed position in supporting engagement with the inner counter.

18. The article of footwear of claim 17, wherein the locking mechanism includes a pawl having a tooth supported by a pawl carrier movably disposed on the inner counter, wherein the inner counter further includes a slot having a recess for engaging with the tooth of the pawl, and wherein the outer counter includes an opening through which the pawl carrier extends when the outer counter is pivoted to the closed position.

19. The article of footwear of claim 17, wherein the locking mechanism includes:

a pair of slides, one slide being disposed on a lateral side of the upper, and the other slide being disposed on a medial side of the upper;

a pair of T-bolts, one for each slide, each T-bolt slidingly extending through the respective slide and having an end secured to the outer heel counter, whereby pivoting of the outer counter moves the T-bolts within the confines of the slides; and at least one release member rotatably coupled to the end of at least one T-bolt, wherein the release member pivots between a first position and a second position, wherein, in the first position, the release member draws the outer counter into a locking engagement with the slides so as to restrict the outer counter from pivoting, and wherein, in the second position, the release member releases the outer counter from the locking engagement with the slides so as to permit the outer counter to pivot relative to the inner counter.

* * * * *